US010175612B2

(12) United States Patent
Koide et al.

(10) Patent No.: US 10,175,612 B2
(45) **Date of Patent: *Jan. 8, 2019**

(54) IMAGE FORMING APPARATUS

(71) Applicant: FUJI XEROX CO., LTD., Tokyo (JP)

(72) Inventors: Takafumi Koide, Kanagawa (JP); Masataka Kuribayashi, Kanagawa (JP); Masahiro Uchida, Kanagawa (JP); Yusuke Fukuda, Kanagawa (JP); Katsuyuki Kitajima, Kanagawa (JP); Koji Funaba, Kanagawa (JP); Kana Yoshida, Kanagawa (JP); Satomi Hara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,299

(22) Filed: Oct. 19, 2017

(65) Prior Publication Data

US 2018/0275568 A1 Sep. 27, 2018

(30) Foreign Application Priority Data

Mar. 24, 2017 (JP) ..... 2017-059531

(51) Int. Cl.
*G03G 9/08* (2006.01)
*G03G 15/16* (2006.01)
*G03G 9/087* (2006.01)

(52) U.S. Cl.
CPC ..... *G03G 15/1605* (2013.01); *G03G 9/0819* (2013.01); *G03G 9/08711* (2013.01); *G03G 9/08755* (2013.01); *G03G 9/08782* (2013.01)

(58) Field of Classification Search
CPC ..... G03G 15/1605; G03G 9/0819; G03G 9/08711; G03G 9/08755; G03G 9/08782
See application file for complete search history.

(56) References Cited

U.S. PATENT DOCUMENTS 5,884,133 A * 3/1999 Morimoto ..... G03G 15/167 399/121
6,013,406 A * 1/2000 Moriki ..... G03G 9/0821 430/108.22
2014/0255839 A1* 9/2014 Taguchi ..... G03G 9/09733 430/105

FOREIGN PATENT DOCUMENTS

JP 2014-56126 A 3/2014

* cited by examiner

*Primary Examiner* — Ryan D Walsh
(74) *Attorney, Agent, or Firm* — Sughrue Mion, PLLC

(57) ABSTRACT

An image forming apparatus includes a transfer unit which includes a belt member having an outer peripheral surface which contacts an image holding member, and a transfer member, and the belt member is wound around both of the image holding member and the transfer member, wherein a toner to be used includes a binder resin containing an amorphous resin and a crystalline resin and has specific physical properties described in the specification, and paraffin wax having a melting temperature of 60° C. to 80° C., and an absolute value of a difference between the melting temperature of the crystalline resin and the melting temperature of the paraffin wax is 10° C. or less.

17 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2017-059531 filed Mar. 24, 2017.

BACKGROUND

1. Technical Field

The present invention relates to an image forming apparatus.

2. Related Art

Image formation according to an electrophotographic method is performed as follows. For example, a surface of an image holding member is charged, then an electrostatic charge image is formed on the surface of the image holding member in accordance with image information, subsequently, the electrostatic charge image is developed with a developer including a toner to form a toner image, and lastly the toner image is transferred and fixed to a surface of a recording medium.

SUMMARY

According to an aspect of the invention, there is provided an image forming apparatus including:

an image holding member;

a charging unit that charges a surface of the image holding member;

an electrostatic charge image forming unit that forms an electrostatic charge image on the charged surface of the image holding member;

a developing unit that includes an electrostatic charge image developer containing an electrostatic charge image developing toner, and develops the electrostatic charge image on the surface of the image holding member to thereby form a toner image;

a transfer unit that transfers the toner image onto a recording medium; and a fixing unit that fixes the toner image on the recording medium, wherein the transfer unit includes a belt member having an outer peripheral surface which contacts the image holding member, and a transfer member, and the belt member is wound around both of the image holding member and the transfer member; and wherein the electrostatic charge image developing toner includes:

a binder resin containing an amorphous resin and a crystalline resin, and paraffin wax, wherein the toner has a volume average particle diameter of 6 μm to 9 μm, a shape factor SF1 of 140 or more, and a toluene-insoluble portion of 25% by weight to 40% by weight, the paraffin wax has a melting temperature of 60° C. to 80° C., and an absolute value of a difference between the melting temperature of the crystalline resin and the melting temperature of the paraffin wax is 10° C. or less.

BRIEF DESCRIPTION OF THE DRAWINGS

Exemplary embodiments of the present invention will be described in detail based on the following figures, wherein.

DETAILED DESCRIPTION

Figure 1:
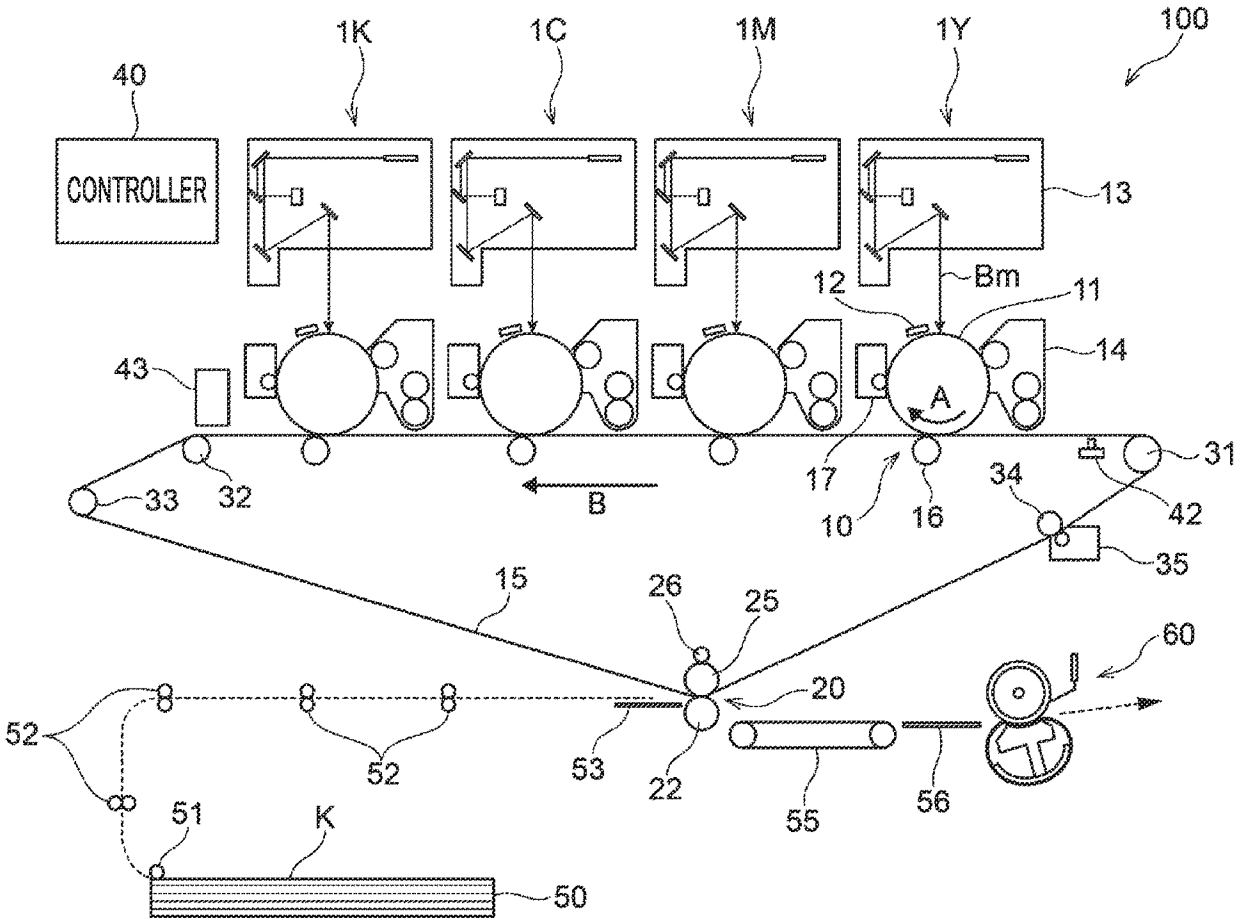
FIG. 1 is a configuration diagram illustrating an example of an image forming apparatus according to the exemplary embodiment.

Hereinafter, the exemplary embodiment which is an example of the invention will be described in detail.

Image Forming Apparatus

An image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer including an electrostatic charge image developing toner (hereinafter, simply referred to as "toner"), and develops the electrostatic charge image formed on the surface of the image holding member as a toner image with the electrostatic charge image the developer, a transfer unit that transfers the toner image formed on the surface of the image holding member to a surface of a recording medium, and a fixing unit that fixes the transferred toner image onto the surface of the recording medium.

In addition, the transfer unit is a belt member having an outer peripheral surface which contacts the image holding member, and a transfer member, and the transfer unit includes one or more transfer members disposed at positions (offset position on the upstream side or downstream side of the belt member in the driving direction) deviating from a contact position (hereinafter, simply referred to as "reference position") between the belt member and the image holding member in a state of not being deformed by the transfer member. For this reason, in the transfer unit, the belt member is wound around both of the image holding member and the transfer member.

Further, the toner includes toner particles containing a binder resin which contains an amorphous resin and a crystalline resin, and paraffin wax having a melting temperature from 60° C. to 80° C., and in the toner, the absolute value of a difference between the melting temperature of the crystalline resin and the melting temperature of the paraffin wax is 10° C. or less, the volume average particle diameter of the toner particles is from 6 μm to 9 μm, a shape factor SF1 of the toner particles is 140 or more, and a toluene-insoluble portion of the toner is from 25% by weight to 45% by weight.

In the toner, the case where the toluene-insoluble portion is from 25% by weight to 45% by weight means that the toner contains an appropriate content of a crosslinked resin. That is, the toluene-insoluble portion means an index of the content of the crosslinked resin contained in the toner.

In addition, in the toner particles, the case where the shape factor SF1 is 140 or more means that the shape of the toner particle is irregular. Note that, the irregular toner particles having the shape factor SF1 of 140 or more typically mean pulverized toner particles prepared by using a pulverization method (for example, a kneading and pulverizing method).

In addition, in the toner particles, the case where the volume average particle diameter is from 6 μm to 9 μm means that the toner particles have a relatively small diameter.

Hereinafter, the toner having the above-described features in the exemplary embodiment may be referred to as a "specific pulverized toner", or simply referred to as a "toner".

In the electrophotographic image forming apparatus, the electrostatic charge image formed on the surface of the image holding member is developed with the developer including a toner so as to form a toner image, the toner image is transferred to the surface of the recording medium from the image holding member, and then the toner image is fixed onto the recording medium so as to form an image on the recording medium. Note that, as a method of transferring the toner image to the surface of the recording medium, a method (direct transferring method) of directly transferring the toner image to the surface of the recording medium from the image holding member, and a method (intermediate transferring method) of firstly transferring the toner image to the intermediate transfer member from the image holding member, and then secondarily transferring the toner image on the intermediate transfer member onto the surface of the recording medium are known. In addition, in the direct transferring method, a belt member (a recording medium feed belt) is used as a recording medium feed member that transports the recording medium to a transfer position where the toner image formed on the surface of the image holding member is transferred to the recording medium, and even in the intermediate transferring method, a belt member (an intermediate transfer belt) is used as the intermediate transfer member.

In addition, toner particles (pulverized toner particles) prepared by using the pulverization method may be used in the electrophotographic image forming apparatus, and from the viewpoint of the low temperature fixability or the like, examples of the pulverized toner particles include toner particles in which the crystalline resin is used as the binder resin, and the paraffin wax having a melting temperature from 60° C. to 80° C. (hereinafter, also simply referred to as "specific paraffin wax") is used as wax.

However, in a case of using the pulverized toner particles including the crystalline resin and the specific paraffin wax, the transfer properties may be deteriorated at the time of transferring the toner image to the recording medium from the image holding member.

The reason for that is presumed as follows.

The pulverized toner particles are generally prepared by mixing the binder resin, the coloring agent, wax, and the like with each other, and then pulverizing the mixture. Due to this preparing method, the shape of the toner particle is likely to be irregular, and the pulverized cross-section becomes the surface of the toner particle, and thereby it is likely that the surface of the toner particle is exposed to the crystalline resin and the specific paraffin wax. Here, the crystalline resin and the specific paraffin wax are relatively soft as compared with other component in the toner particles, and thus the pulverized toner particles exposed to the surface of the crystalline resin and the specific paraffin wax are likely to have high adhesiveness. As result, at the time of transferring the toner image formed on the image holding member to the surface of the recording medium, more specifically, at the time of transferring the toner image on the image holding member to the surface of the recording medium in the direct transferring method, at the time of primarily transferring the toner image formed on the image holding member to the surface of the intermediate transfer member in the intermediate transferring method, and at the time of secondarily transferring the toner image formed on the intermediate transfer member to the surface of the recording medium, the pulverized toner particles are less likely to be released from, the image holding member or the intermediate transfer member as the adhesiveness becomes higher. As result, it is considered that the transfer properties of the toner image are deteriorated.

In addition, as the toner, a toner having external additives added to the surface of the pulverized toner particle may be used. Since the external additives present on the surface of the pulverized toner particle exhibit a spacer effect by being nipped between the pulverized toner particles and other members, the transfer properties of the toner image are imparted to the recording medium from the image holding member. However, as described above, in the pulverized toner particles containing the crystalline resin and the specific paraffin wax, the surface of the pulverized toner particle is likely to be exposed to the relatively soft crystalline resin and specific paraffin wax, and thus the external additives are easily embedded into the surface of the pulverized toner particle, that is, the structure of the external additives is changeable. The embedded external additives are difficult to exhibit the spacer effect, and from this viewpoint, when using the pulverized toner particles containing the crystalline resin and the specific paraffin wax, the transfer properties of the toner image are considered to be deteriorated.

In contrast, in the image forming apparatus according to the exemplary embodiment, the transfer unit includes the transfer member disposed at a position (offset position) deviating from a contact position (reference position) between the belt member and the image holding member in a state of not being deformed by the transfer member, and with this, the belt member is wound around both of the image holding member and the transfer member.

With this, a nip (a contact area having large contact area) having a large width is formed as compared with a case of including the transfer member disposed at the reference position without the transfer member at the offset position. In other words, in the transfer unit using the direct transferring method, a wide nip is formed over the transfer position from the image holding member to the recording medium, and the time of the state where the toner image is nipped between the image holding member, the recording medium, and the recording medium feed belt becomes longer. In addition, in the transfer unit using the intermediate transferring method, the wide nip is formed over the primary transfer position from the image holding member to the intermediate transfer belt, and the time of the state where the toner image is nipped between the image holding member and the intermediate transfer belt becomes longer.

As a result, it is considered that the transfer properties of transferring the toner image from the image holding member to the surface of the recording medium (the transfer properties of transferring the toner image from the image holding member to the recording medium in the direct transferring method, and the primary transfer properties of transferring the toner image from the image holding member to the surface of the intermediate transfer member (the intermediate transfer belt) in the intermediate transferring method are improved, and the high transfer efficiency is achieved.

As described above, it is possible to obtain high transfer efficiency of the toner image according to the exemplary embodiment.

Nip Width

The transfer unit in the exemplary embodiment, a nip formed by the contact area between the image holding member and the belt member has a width (the length of the contact area of the belt member in the circumferential direction (that is, a driving direction)) of preferably 5 mm or more, and more preferably 20 mm or more.

When the nip width is within the above range, it is likely that the time of the state where the toner image is nipped between the image holding member and the belt member becomes longer, and the transfer properties are improved.

On the other hand, an upper limit value of the nip width may be 60 mm or less and is preferably 40 mm or less, from the viewpoint of preventing torque increase.

Next, a configuration of the image forming apparatus according to the exemplary embodiment will be described in Configuration of Image Forming Apparatus The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains an electrostatic charge image developer including an electrostatic charge image developing toner, and develops the electrostatic charge image formed on the surface of the image holding member as a toner image with the electrostatic charge image the developer, a transfer unit that transfers the toner image formed on the surface of the image holding member to a surface of a recording medium, and a fixing unit that fixes the toner image onto the surface of the recording medium.

In addition, the transfer unit includes a belt member having an outer peripheral surface which contacts the image holding member, and a transfer member, and the transfer unit includes one or more transfer members disposed at positions (offset position on the upstream side or downstream side of the belt member in the driving direction) deviating from a contact position (reference position) between the belt member and the image holding member in a state of not being deformed by the transfer member. For this reason, in the transfer unit, a portion of the image holding member and a portion of the belt member contact each other.

Note that, in the transfer unit in the exemplary embodiment, the use of the belt member is not particularly limited. For example, the belt member is used as the intermediate transfer belt in the transfer unit using the intermediate transferring method, and the recording medium feed belt in the transfer unit using the direct transferring method.

In a case of the exemplary embodiment that the belt member is provided in the transfer unit as the intermediate transfer belt, the transfer unit is configured to include an intermediate transfer belt (a belt member), a primary transfer unit that primarily transfers the toner image formed on the surface of the image holding member to the surface of the intermediate transfer belt, and a secondary transfer unit that secondarily transfers the toner image transferred to the surface of the intermediate transfer belt to the recording medium.

In addition, in a case of the exemplary embodiment that the belt member is provided in the transfer unit as the recording medium feed belt, the transfer unit is configured to include a recording medium feed belt (the belt member) that transports the recording medium to the transfer position where the toner image formed on the surface of the image holding member is transferred to the recording medium, and a transfer unit that transfers the toner image formed on the surface of the image holding member to the surface of the recording medium.

Further, examples of the image forming apparatus according to the exemplary embodiment include a typical monochrome image forming apparatus in which only monochrome toner is accommodated in the developing device, a color image forming apparatus in which the toner image held on the image holding member is sequentially primarily transferred onto the intermediate transfer member in a repeated manner, and a tandem type color image forming apparatus in which plural image holding members provided with development devices of respective colors are linearly arranged on the intermediate transfer member.

Hereinafter, the image forming apparatus according to the exemplary embodiment will be described with reference to the drawings.

Configuration of Image Forming Apparatus

First Exemplary Embodiment

First, an example of the image forming apparatus using the belt member as the intermediate transfer belt in the transfer unit will be described.

FIG. 1 is a schematic configuration diagram illustrating a configuration of an example of the image forming apparatus according to the exemplary embodiment.

As illustrated in FIG. 1, an image forming apparatus according to the exemplary embodiment 100 is generally called a tandem type image forming apparatus using an intermediate transferring method, and plural image forming units 1Y, 1M, 1C, and 1K that form toner images of the respective colors by using an electrophotographic method, a primary transfer unit 10 that sequentially transfers (primarily transfers) the toner images of the respective colors formed by the respective image forming units 1Y, 1M, 1C, and 1K to the intermediate transfer belt 15 (an example of the belt member), a secondary transfer unit 20 that collectively transfers (secondarily transfers) a superimposed toner image transferred on to the intermediate transfer belt 15 to a paper K which is a recording medium, and a fixing device 60 that fixes the secondarily transferred image onto the paper K. In addition, the image forming apparatus 100 includes a controller 40 that controls an operation of each of devices (units).

Each of the image forming units 1Y, 1M, 1C, and 1K of the image forming apparatus 100 is provided with a photoreceptor 11 (an example of the image holding member) that rotates in a direction of an arrow A and holds a toner image formed on the surface.

In the circumference of the photoreceptor 11, a charging device 12 that charges the photoreceptor 11 is provided as an example of the charging unit, and a laser exposure device 13 (an exposure beam in the drawings is denoted by Bm) that writes an electrostatic charge image on the photoreceptor 11 is provided as an example of an electrostatic charge forming unit In addition, in the circumference of the photoreceptor 11, a development device 14 that accommodates color toners and visualizes the electrostatic charge image on the photoreceptor 11 is provided as an example of the developing unit. Note that, the above-described specific pulverized toner is used as at least one of the respective color component toners. In the exemplary embodiment, all of the respective color component toners may be the above-described specific pulverized toner.

In addition, a primary transfer roller 16 (an example of the transfer member) that transfers the respective color toner images formed on the photoreceptor 11 to the intermediate transfer belt 15 in the primary transfer unit 10.

Here, offset of the primary transfer roller 16 will be described.

Figure 2:
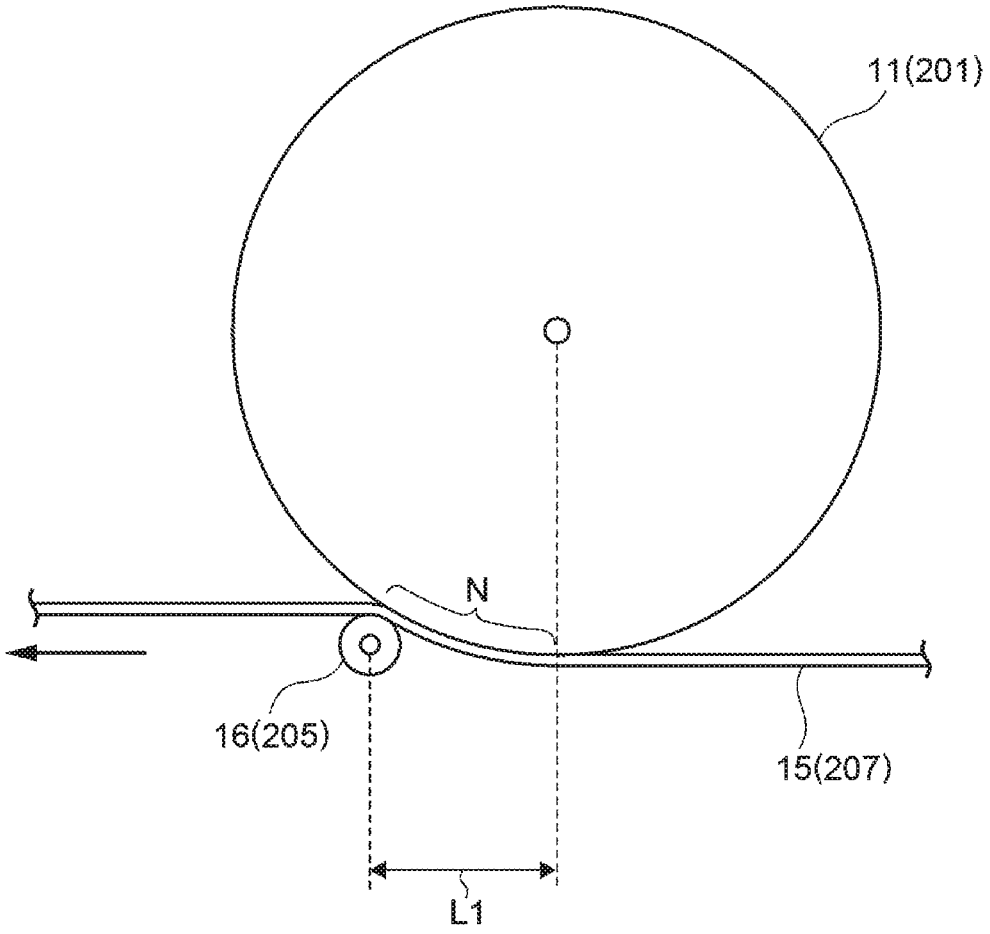
FIG. 2 is a schematic view illustrating an example of a positional relationship of an image holding member and a transfer member in the image forming apparatus according to the exemplary embodiment.

In the image forming apparatus 100 as illustrated in FIG. 1, the primary transfer roller 16 is disposed at a position (offset position) deviating from the intermediate transfer belt 15 in the driving direction. Specifically, as illustrated in FIG. 2, the primary transfer roller 16 is disposed at a position deviating from the contact position (the reference position) between the intermediate transfer belt 15 (the belt member) and the photoreceptor 11 (the image holding member) in a state of not being deformed by the primary transfer roller 16 (the transfer member) to the driving direction side of the intermediate transfer belt 15 by distance L1. In other words, the primary transfer roller 16 is disposed at a positional relationship in which a straight line connecting the axial center of the primary transfer roller 16 and the axial center of the photoreceptor 11 is in the direction which is not orthogonal to the driving direction of the intermediate transfer belt 15 in a state not being deformed by the primary transfer roller 16 (the transfer member). With this, a portion of the photoreceptor 11 and a portion of the intermediate transfer belt 15 contact each other, and a nip N is formed between the photoreceptor 11 and the intermediate transfer belt 15.

Further, in the circumference of the photoreceptor 11, a photoreceptor cleaner 17 in which residual toners on the photoreceptor 11 are removed is provided, and thus the charging device 12, the laser exposure device 13, the development device 14, the primary transfer roller 16, and an electrophotography device of the photoreceptor cleaner 17 are sequentially disposed along the rotational direction of the photoreceptor 11. The image forming units 1Y, 1M, 1C, and 1K are arranged in a substantially straight line in order of yellow (Y), magenta (M), cyan (C), and black (K) from the upstream side of the intermediate transfer belt 15.

The intermediate transfer belt 15 is circulated (rotated) by the various rollers at the speed matching the purpose in the direction B as illustrated in FIG. 1. Examples of various kinds of rollers include a drive roller 31 that is driven by a motor (not shown) to rotate the intermediate transfer belt 15, a support roller 32 that supports the intermediate transfer belt 15 extending in a substantially straight line along the direction in which the respective photoreceptors 11 are arranged, a tension apply roller 33 that applies tension to the intermediate transfer belt 15 and functions as a correction roller that prevents meandering of the intermediate transfer belt 15, a back surface roller 25 that is provided in the secondary transfer unit 20, and a cleaning back surface roller 34 that is provided in a cleaning unit that scratching residual toners on the intermediate transfer belt 15.

The primary transfer unit 10 is configured to include the primary transfer roller 16 as a facing member which is disposed facing the photoreceptor 11 with the intermediate transfer belt 15 nipped therebetween. The primary transfer roller 16 is configured to include a core, and a sponge layer as an elastic layer which is fixed around the core. The core is a cylindrical bar made of metal such as iron and SUS. The sponge layer is a sponge-shaped cylindrical roller formed of blended rubbers of nitrile rubber (NBR), styrene butadiene rubber (SBR), and ethylene propylene rubber (EPDM) which are obtained by mixing a conductive material such as carbon black, and has the volume resistivity from $10^{7.5}$ Ωcm to $10^{8.5}$ Ωcm.

In addition, the primary transfer roller 16 is disposed to be pressed by the photoreceptor 11 with the intermediate transfer belt 15 nipped therebetween, and a voltage (primary transfer bias) of the charged polarity (negative polarity, the same applies hereafter) and the opposite polarity of the toner is applied to the primary transfer roller 16. With this, the toner image on each of the photoreceptors 11 is sequentially electrostatically transferred to the intermediate transfer belt 15, and the superimposed toner image is formed on the intermediate transfer belt 15.

The secondary transfer unit 20 is configured to include a back surface roller 25 and a secondary transfer roller 22 which is disposed on the toner image holding surface side of the intermediate transfer belt 15.

The back surface roller 25 has a configuration in which a surface is formed of a blended rubber tube of carbon-dispersed EPDM and NBR, and an inner portion is formed of EPDM. In addition, the surface resistivity thereof is from $10^{7}$ Ω/square to $10^{10}$ Ω/square, and the hardness is set to be, for example, 70° (ASKER-C (manufactured by Kobunshi Reiki Co., Ltd., the same applies hereafter). The back surface roller 25 is disposed on the back surface side of the intermediate transfer belt 15 and is configured to be a facing electrode of the secondary transfer roller 22. A metal power supply roller 26 to which secondary transfer bias is stably applied is disposed to contact the back surface roller 25.

On the other hand, the secondary transfer roller 22 is configured to include a core, and a sponge layer as an elastic layer which is fixed around the core. The core is a cylindrical bar made of metal such as iron and SUS. The sponge layer is a sponge-shaped cylindrical roller formed of blended rubber of NBR, SBR, and EPDM which are obtained by mixing a conductive material such as carbon black, and has the volume resistivity from $10^{7.5}$ Ωcm to $10^{8.5}$ Ωcm.

In addition, the secondary transfer roller 22 is disposed to be pressed by the back surface roller 25 with the intermediate transfer belt 15 nipped therebetween, the secondary transfer roller 22 is grounded such that a secondary transfer bias is formed between the back surface rollers 25, and the toner image is secondarily transferred on the paper K transported to the secondary transfer unit 20.

In addition, an intermediate transfer belt cleaner 35 that removes the residual toner and paper powders on the intermediate transfer belt 15 after the secondary transfer, and cleans the surface of the intermediate transfer belt 15 is detachably provided on the downstream, side of the secondary transfer unit 20 of the intermediate transfer belt 15.

Note that, the intermediate transfer belt 15, the primary transfer unit 10 (the primary transfer roller 16), and the secondary transfer unit 20 (the secondary transfer roller 22) correspond to examples of the transfer unit.

On the other hand, a reference sensor (home position sensor) 42 that generates a reference signal as a reference for taking image formation timing in each of the image forming units 1Y, 1M, 1C, and 1K is disposed on the upstream of the yellow image forming unit 1Y. Further, an image density sensor 43 for performing image quality adjustment is disposed on the downstream side of the black image forming unit 1K. The reference sensor 42 generates the reference signal by recognizing marks provided on the back side of the intermediate transfer belt 15, and each of the image forming units 1Y, 1M, 1C, and 1K starts performing image formation bv the instruction from the controller 40 based on the reference signal recognition.

Further, in the image forming apparatus according to the exemplary embodiment, examples of the feed unit that supplies the paper K include a paper accommodating unit 50 that accommodates the paper K, a paper supply roller 51 that take out the paper K accommodated in the paper accommodating unit 50 at a predetermined timing and supplies the paper K, a feed roller 52 that supplies the paper K fed-out by the paper supply roller 51, a feed guide 53 that guides the paper K transported from the feed roller 52 to the secondary transfer unit 20, a feed belt 55 that supplies the paper K transported after being secondarily transferred by the secondary transfer roller 22 to the fixing device 60, and a fixing entrance guide 56 that guides the paper K to the fixing device 60.

Next, a basic image forming process of the image forming apparatus according to the exemplary embodiment will be described.

In the image forming apparatus according to the exemplary embodiment, image data output from an image reading device (not shown) or a personal computer (PC) (not shown) or the like is subjected to image processing by the image processing apparatus (not shown), and then is subjected to an image forming operation by the image forming units 1Y, 1M, 1C, and 1K.

In the image processing apparatus, image processing of various image editions such as shading correction, misalignment correction, lightness and color space conversion, gamma correction, border erase and color edition, and move edition are performed on the input reflectance data. The image data which is subjected to the image processing is converted into color material gradation data with four colors of Y, M, C, and K, and then output to the laser exposure device 13.

In the laser exposure device 13, in accordance with the input color material gradation data, for example, an exposure beam Bm emitted from the semiconductor laser is applied to the photoreceptor 11 of each of the image forming units 1Y, 1M, 1C, and 1K. In the photoreceptor 11 of each of the image forming units 1Y, 1M, 1C, and 1K, after the surface is charged by the charging device 12, the surface is scanned with and exposed to the light by the laser exposure device 13, and thereby an electrostatic charge image is formed. The formed electrostatic charge image is developed as a toner image for each color of Y, M, C, and K by each of the image forming units 1Y, 1M, 1C, and 1K.

The toner image formed on the photoreceptor 11 of each of the image forming units 1Y, 1M, 1C, and 1K is transferred to the intermediate transfer belt 15 at a nip N formed in the primary transfer unit 10 at which each photoreceptor 11 and the intermediate transfer belt 15 contact each other. More specifically, in the primary transfer unit 10, the voltage (primary transfer bias) of the charged polarity of the toner (negative polarity) and the opposite polarity is applied to the substrate of the intermediate transfer belt 15 by the primary transfer roller 16, and the toner image is sequentially superimposed on the surface of the intermediate transfer belt 15 so as to perform primary transfer.

After the toner images are sequentially primarily transferred to the surface of the intermediate transfer belt 15, the intermediate transfer belt 15 moves such that the toner image is transported to the secondary transfer unit 20. When the toner image is transported to the secondary transfer unit 20, in the feed unit, the paper supply roller 51 rotates in accordance with the timing when the toner image is transported to the secondary transfer unit 20, and a paper K in a desired size is transported from the paper accommodating unit 50. The paper K fed by the paper supply roller 51 is fed by the feed roller 52, and reaches the secondary transfer unit 20 through the feed guide 53. Before reaching the secondary transfer unit 20, the paper K is temporarily stopped, and a positioning roller (not shown) rotates in accordance with the movement timing of the intermediate transfer belt 15 holding the toner image, and thereby the position of the paper K and the position of the toner image are aligned with each other.

In the secondary transfer unit 20, the secondary transfer roller 22 is pressed by the back surface roller 25 via the intermediate transfer belt 15. In this case, the paper K fed in accordance with the timing is nipped between the intermediate transfer belt 15 and the secondary transfer roller 22. At this time, when a voltage (secondary transfer bias) of the charged polarity of the toner (negative polarity) and the same polarity is applied from the power supply roller 26, a transfer electric field is formed between the secondary transfer roller 22 and the back surface roller 25. In addition, unfixed toner images held on the intermediate transfer belt 15 are collectively electrostatically transferred to the paper K in the secondary transfer unit 20 pressed by the secondary transfer roller 22 and the back surface roller 25.

After that, the paper K on which the toner images are electrostatically transferred is fed by the secondary transfer roller 22 in a state of being separated from the intermediate transfer belt 15, and then fed to the feed belt 55 provided on downstream side of the paper feed direction of the secondary transfer roller 22. In the feed belt 55, the paper K is fed to the fixing device 60 in accordance with the optimal feed speed in the fixing device 60. The unfixed toner image on the paper K fed to the fixing device 60 is fixed on the paper K by being subjected to a fixing treatment with heat and pressure by the fixing device 60. In addition, the paper K on which the fixed image is formed is fed to a discharged paper accommodating unit (not shown) provided in discharging unit of the image forming apparatus.

On the other hand, after transferring the toner image to the paper K, the residual toner on the intermediate transfer belt 15 is fed to the cleaning unit following the rotation of the intermediate transfer belt 15, and removed from the intermediate transfer belt 15 by the cleaning back surface roller 34 and the intermediate transfer belt cleaner 35.

Although the exemplary embodiment has been described above, it is not to be construed as being limited to the exemplary embodiment, and various modifications, changes, and improvements are possible.

Another Exemplary Embodiment of the Number of Primary Transfer Rollers (Transfer Member) and Disposition Thereof In FIG. 1 and 2, regarding the number of the primary transfer rollers and disposition thereof in the image forming apparatus according to the first exemplary embodiment, an exemplary embodiment in which one primary transfer roller 16 (the transfer member) is disposed at a position facing one photoreceptor 11 (the image holding member) via the intermediate transfer belt 15 (the belt member) is described. However, the disposition of the transfer member with respect to one image holding member in the exemplary embodiment is not described as above. For example, plural transfer members may be disposed at a position facing one image holding member via the bell member.

Figure 3:
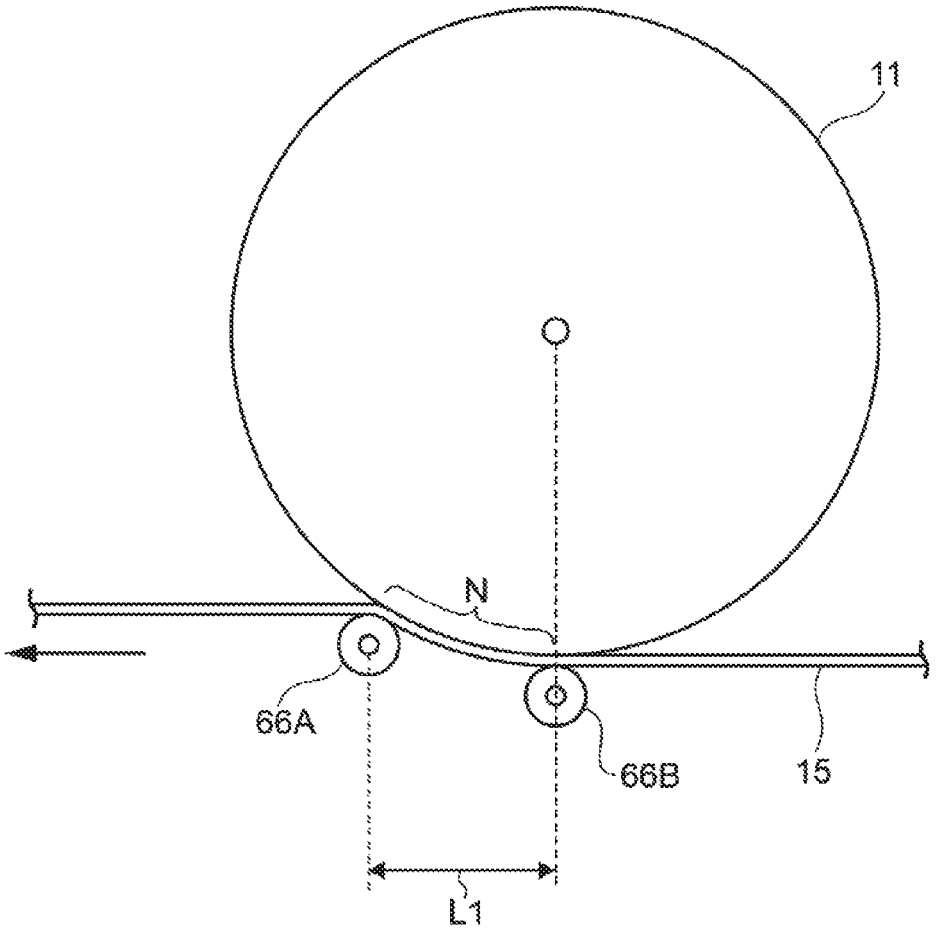
FIG. 3 is a schematic view illustrating another example of the positional relationship of an image holding member and a transfer member in the image forming apparatus according to the exemplary embodiment.

For example, as illustrated in FIG. 3, two primary transfer rollers 66A and 66B (the transfer members) may be disposed at a position facing one photoreceptor 11 (the image holding member) via the intermediate transfer belt 15 (the belt member). In FIG. 3, the primary transfer roller 66A is disposed at a position (offset position) deviating from the reference position (the contact position between the intermediate transfer belt 15 and the photoreceptor 11 in a state of not being deformed by the primary transfer rollers 66A and 66B) to the driving direction side of the intermediate transfer belt 15 by distance L1, and the primary transfer roller 66B is disposed at the reference position. With this, a portion of the photoreceptor 11 and a portion of the intermediate transfer belt 15 contact each other, and a nip N is formed between the photoreceptor 11 and the intermediate transfer belt 15.

Note that, the intermediate transfer belt 15 (the belt member) is pressed to the photoreceptor 11 (the image holding member) by the plural primary transfer rollers 66A and 66B (the transfer members), and thus nip pressure (pressure applied to the toner image passing through the nip from the photoreceptor 11 (the image holding member) and the intermediate transfer belt 15 (the belt member)) is likely to be high, and as a result, the transfer efficiency of the toner image is likely to be improved.

Figure 4:
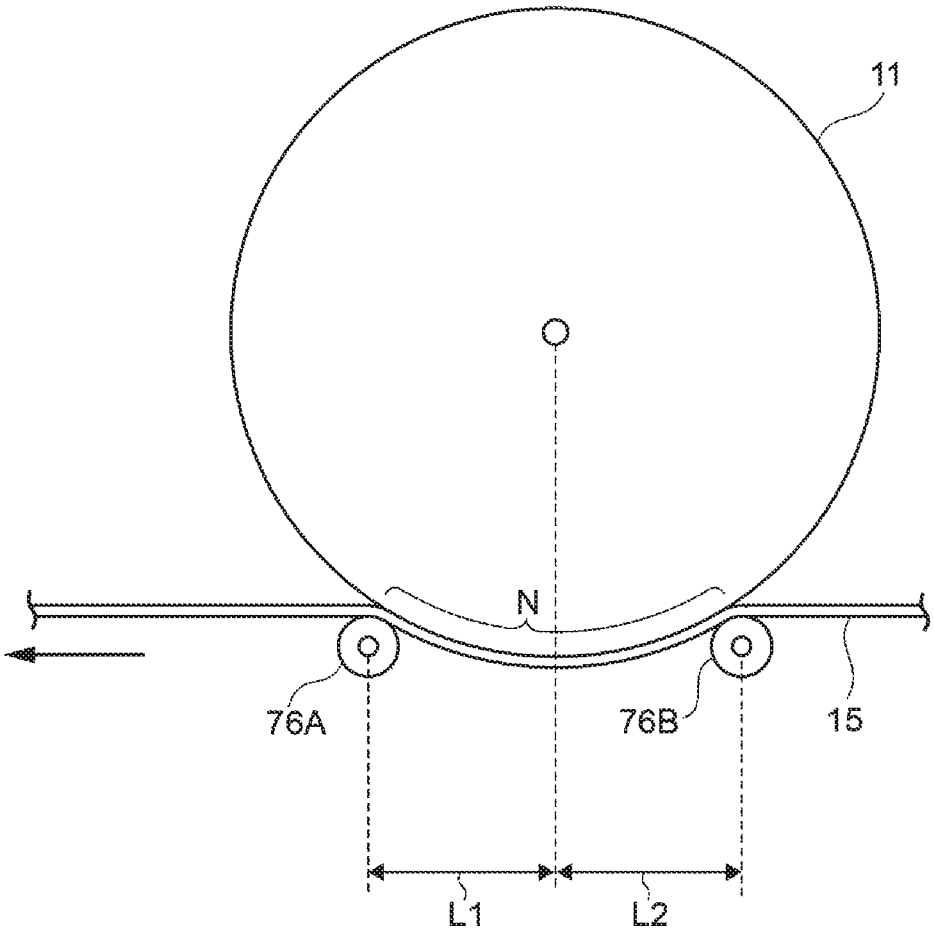
FIG. 4 is a schematic view illustrating another example of the positional relationship of an image holding member and a transfer member in the image forming apparatus according to the exemplary embodiment.

Further, as illustrated in FIG. 4, two primary transfer rollers 76A and 76B (the transfer members) may be disposed at a position facing one photoreceptor 11 (the image holding member) via the intermediate transfer belt 15 (the belt member), and the two primary transfer rollers 76A and 76B may be disposed at a position deviating from, the reference position. In other words, in FIG. 4, the primary transfer roller 76A is disposed at a position (offset position) deviating from the reference position (the contact position between the intermediate transfer belt 15 and the photoreceptor 11 in a state of not being deformed by the primary transfer rollers 76A and 76B) to the upstream side of the intermediate transfer belt 15 in the driving direction by distance L1, and the primary transfer roller 76B is disposed at a position (offset position) deviating from the reference position to the downstream, side of the intermediate transfer belt 15 in the driving direction by distance L2. With this, a portion of the photoreceptor 11 and a portion of the intermediate transfer belt 15 contact each other, and a nip N is formed between the photoreceptor 11 and the intermediate transfer belt 15.

Note that, the primary transfer rollers 76A and 76B (the transfer members) are disposed at positions deviating from the reference position to the downstream side and upstream side of the intermediate transfer belt 15 (the belt member) in the driving direction, a wider nip N is formed, and as a result, the transfer efficiency of the toner image is likely to be improved.

Figure 5:
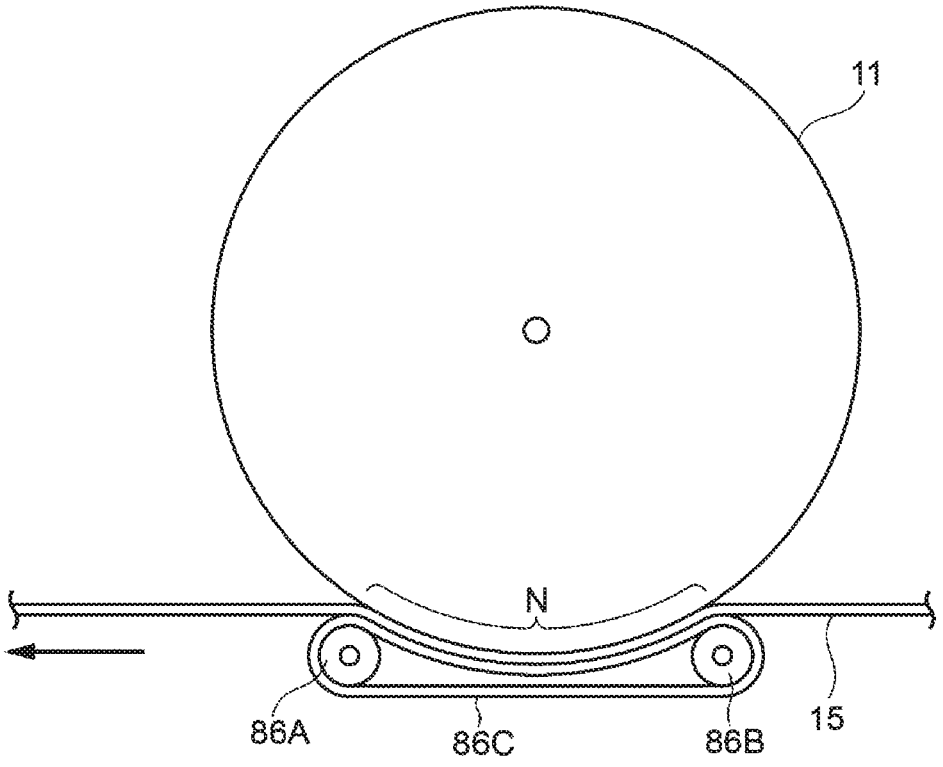
FIG. 5 is a schematic view illustrating another example of the positional relationship of an image holding member and a transfer member in the image forming apparatus according to the exemplary embodiment.

Further, as illustrated in FIG. 5, two primary transfer rollers 86A and 86B (the transfer members) may be disposed at a position facing one photoreceptor 11 (the image holding member) via the intermediate transfer belt 15 (the belt member), and a pressure applying belt 86C that is provided along the two primary transfer rollers 86A and 86B, and applies pressure to the intermediate transfer belt 15 in the direction of the photoreceptor 11 may be provided. That is, in FIG. 5, the primary transfer roller 86A is disposed at a position (offset position) deviating from the reference position (the contact position between the intermediate transfer belt 15 and the photoreceptor 11 in a state of not being deformed by the primary transfer rollers 86A and 86B) to the deviating position (offset position) toward the downstream side of the intermediate transfer belt 15 in the driving direction, and the primary transfer roller 86B is disposed a position deviating from the reference position to the upstream side of the intermediate transfer belt 15 in the driving direction. In addition, the pressure applying belt 86C is provided along the primary transfer rollers 86A and 86B, and the primary transfer rollers 86A and 86B are disposed to contact the intermediate transfer belt 15 via the pressure applying belt 86C. With the pressure applying belt 86C, the pressure is applied to the intermediate transfer belt 15 even in the area between the primary transfer rollers 86A and 86B, and thus the nip pressure (pressure applied to the toner image passing through the nip from the photoreceptor 11 (the image holding member) and the intermediate transfer belt 15 (the belt member)) is likely to be high, and as a result, the transfer efficiency of the toner image is likely to be improved.

Note that, in a case where the plural transfer members are disposed with respect to one image holding member, and the voltage (transfer bias) of the charged polarity of the toner and the opposite polarity may be applied to at least one transfer member, and the transfer bias may be applied to all of the transfer members. Here, it is further preferable that the transfer bias is applied to at least the transfer members arranged on the most upstream side of the belt member in the driving direction.

Accordingly, for example, according to the exemplary embodiment illustrated in FIG. 3, the transfer member to which the transfer bias is applied may be any one of the primary transfer rollers 66A and 66B, and both of the primary transfer rollers 66A and 66B. Here, it is further preferable that the transfer bias is applied to at least the primary transfer roller 66B disposed on the upstream side of the belt member in the driving direction.

In addition, according to the exemplary embodiment as illustrated FIG. 4, the transfer member to which the transfer bias is applied may be any one or both of the primary transfer rollers 76A and 76B, and it is further preferable that the transfer bias is applied to at least the primary transfer roller 76B disposed on the upstream side of the belt member in the driving direction.

In addition, according to the exemplary embodiment as illustrated in FIG. 5, the transfer member to which the transfer bias is applied may be any one or both of the primary transfer rollers 86A and 86B, and it is further preferable that the transfer bias is applied to at least the primary transfer roller 86B disposed on the upstream side of the belt member in the driving direction.

Configuration of Image Forming Apparatus (Second Exemplary Embodiment)

Next, in the transfer unit, an example of the image forming apparatus in which the belt member is used as the recording medium feed belt (a paper feed belt) will be described.

Figure 6:
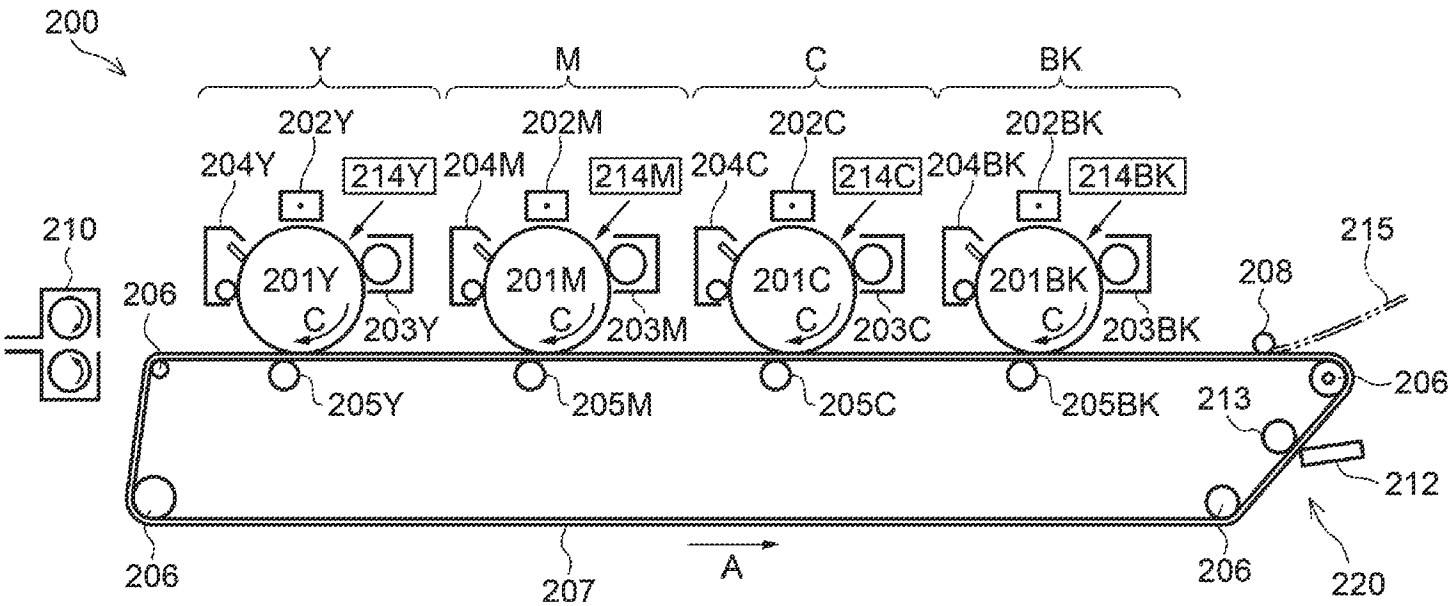
FIG. 6 is a configuration diagram illustrating another example of the image forming apparatus according to the exemplary embodiment.

FIG. 6 is a configuration diagram illustrating another example of the image forming apparatus according to the exemplary embodiment.

In the image forming apparatus 200 as illustrated in FIG. 6, each of units Y, M, C, and BK is provided with each of photoreceptor drums 201Y, 201M, 201C, and 201BK (examples of the of the image holding member) so as to rotate in the clockwise direction of an arrow C. In the circumference of the photoreceptor drums 201Y, 201M, 201C, and 201BK, charging devices 202Y, 202M, 202C, and 202BK (examples of the charging unit), exposure devices 214Y, 214M, 214C, and 214BK (examples of the electrostatic charge image forming unit), color developing devices (a yellow developing device 203Y, a magenta developing device 203M, a cyan developing device 203C, and a black developing device 203BK) (examples of the developing unit), and photoreceptor drum cleaning members 204Y, 204M, 204C, and 204BK are disposed.

Note that, the above-described specific pulverized toner is accommodated in at least one of the color developing devices. In the exemplary embodiment, all of the color developing devices may accommodate the above-described specific pulverized toner.

Although four units of Y, M, C, and BK are arranged in order of BK, C, M, and Y in parallel to a paper feed belt 207 (an example of the belt member), the order of the units is set in accordance with an image forming method such as an order of units BK, Y, C, and M.

The paper feed belt 207 is supported from the inner side by four belt support rollers 206, and constitutes an intermediate transfer belt unit. The paper feed belt 207 rotates at the same peripheral speed as that of the photoreceptor drums 201Y, 201M, 201C, and 201BK in the counterclockwise direction of the arrow A, and a portion thereof positioned between the belt support rollers 206 is disposed so as to contact the photoreceptor drums 201Y, 201M, 201C, and 201BK.

Transfer rollers 205Y, 205M, 205C, and 205BK (examples of the transfer unit) are disposed at a position which is the inside of the paper feed belt 207 and faces a portion where the paper feed belt 207 and the photoreceptor drums 201Y, 201M, 201C, and 201BK contact each other, and constitute a transfer area in which the toner image is transferred to a paper 215 (an example of the recording medium) via the photoreceptor drums 201Y, 201M, 201C, and 201BK and the paper feed belt 207.

Note that, even in the image forming apparatus 200, as illustrated in FIG. 2, the transfer roller 205 is disposed at a position deviating (offset) from the paper feed belt 207 in the driving direction. Specifically, the transfer roller 205 is disposed at a position deviating from the contact position (the reference position) between the paper feed belt 207 (the belt member) and the photoreceptor drum 201 (the image holding member) in a state of not being deformed by the transfer roller 205 (the transfer member) to the driving direction side of the paper feed belt 207 by distance L1. In other words, the transfer roller 205 is disposed at a positional relationship in which a straight line connecting the axial center of the transfer roller 205 and the axial center of photoreceptor drum 201 is in the direction which is not orthogonal to the driving direction of the paper feed belt 207 in a state not being deformed by the transfer roller 205 (the transfer member). With this, a portion of the photoreceptor drum 201 and a portion of the paper feed belt 207 contact each other, and a nip N is formed between the photoreceptor drum 201 and the paper feed belt 207.

Further, in the second exemplary embodiment, the disposition of the transfer roller 205 (the transfer member) with respect to one photoreceptor drum 201 (the image holding member) is not limited as described above. For example, the plural transfer rollers 205 may be disposed at a position facing one photoreceptor drum 201 via the paper feed belt 207 (the belt member).

For example, as described in the first exemplary embodiment, the exemplary embodiment (two transfer members are disposed at a position facing one image holding member via the belt member; one transfer member is disposed at the reference position, and the other transfer member is disposed at a position deviating from the reference position) as illustrated in FIG. 3, the exemplary embodiment (two transfer members are disposed at a position facing one image holding member via the belt member, and both of two transfer members are disposed at a position deviating from the reference position) as illustrated in FIG. 4, and the exemplary embodiment (two transfer members are disposed at a position facing one image holding member via the belt member, and the pressure applying belt that is provided along the two transfer members, and applies pressure to the belt member in the direction of the image holding member is be provided) as illustrated in FIG. 5 may be employed.

Note that, in a case where the plural the transfer member are disposed with respect to one image holding member, the voltage (transfer bias) of the charged polarity of the toner and the opposite polarity may be applied to at least one transfer member, and the transfer bias may be applied to all of the transfer members. In this regard, it is further preferable that the transfer bias is applied to at least the transfer members arranged on the most upstream side of the belt member in the driving direction.

On the paper feed belt 207, the cleaning blade 212 is disposed so as to contact the surface (outer peripheral surface) on which the paper is fed. In addition, as a conductive facing member, a facing roller for cleaning 213 is disposed on the surface opposite to the cleaning blade 212 via the paper feed belt 207, and constitutes the paper feed belt cleaning device 220.

The paper feed belt cleaning device 220 may be provided with brush cleaning, roll cleaning, scraper cleaning and the like in addition to the cleaning blade 212.

The fixing device 210 (an example of the fixing unit) is disposed such that the paper is transported after passing through each of the transfer areas of the paper feed belt 207 and the photoreceptor drums 201Y, 201M, 201C, and 201BK.

The paper 215 is fed to the paper feed belt 207 by a paper feed roller 208.

In the image forming apparatus as illustrated in FIG. 6, a photoreceptor drum 201BK is rotated in the unit BK. With this, a charging device 202BK is driven so as to charge the surface of the photoreceptor drum 201BK to the desired polarity and potential. The surface-charged photoreceptor drum 201BK is exposed image wise by the exposure device 214BK, and an electrostatic charge image is formed on the surface thereof.

Subsequently, the electrostatic charge image is developed by the black developing device 203BK. Then, the toner image is formed on the surface of the photoreceptor drum 201BK. The developer at this time may be one-component type or two-component type.

The toner image is sequentially transferred onto the surface of the paper 215 by an electric field formed by the transfer bias applied from the transfer roller 205BK when the paper 215 passes through a nip N formed in the transfer area between the photoreceptor drum 201BK and the paper feed belt 207, and then is transported to the transfer area by being electrostatically attracted to the paper feed belt 207.

After that, the residual toner on the photoreceptor drum 201BK is cleaned and removed by a photoreceptor drum cleaning member 204BK. In addition, the photoreceptor drum 201BK is used for the following image transfer.

The image transfer as described above is performed by using the above-described method even in the case of units C, M, and Y.

The paper 215 to which the toner images are transferred by the transfer rollers 205BK, 205C, 205M, and 205Y is transported to the fixing device 210 and the fixing is performed.

The residual toners on the photoreceptor drums 201Y, 201M, 201C, and 201BK after transfer are removed by the photoreceptor drum cleaning members 204Y, 204M, 204C, and 204BK. On the other hand, in the paper feed belt 207 after transporting the recording medium 215, the residual toner is removed by the cleaning blade 212 in the paper feed belt cleaning device 220 to prepare for the next image forming process.

Thus, an image is formed on the paper.

Hereinafter, the belt member used in the transfer unit will be described.

Belt Member in Transfer Unit

The belt member maybe configured to include, for example, a resin material. In addition, a conductive material may be contained from the viewpoint of imparting conductivity, and other well-known additives may also be contained.

Examples of the resin material used for the belt member include a polyimide resin, a fluorinated polyimide resin, a polyamide resin, a polyamide iraide resin, a polyether ether ester resin, a polyarylate resin, and a polyester resin. For the belt member, the resin material may be used alone and two or more types thereof may be used in combination.

Among them, from the viewpoint of enhancing the rigidity of the inner peripheral surface and obtaining the difficulty of deformation when plural rollers are tensioned and bridged, at least one of a polyimide resin and a polyamide imide resin may be used.

A conductive material may be contained in the belt member from the viewpoint of imparting conductivity.

Examples of the conductive material include a conductive particle (for example, the volume resistivity is less than $10^7$ Ω·cm, the same applies hereafter) or a semiconductive particle (for example, the volume resistivity is from $10^7$ Ω·cm to $10^{13}$ Ω·cm, the same applies hereafter).

Note that, as the conductive material, a particle having the first primary particle diameter of less than 10 μm is preferably used, a particle having the first primary particle diameter of 1 μm or less is further preferably used.

The conductive material is not particularly limited. For example, examples thereof include carbon black (for example, ketchen black, acetylene black, and surface-oxidized carbon black), carbon materials such as carbon fiber, carbon nanotube, and graphite, metal or alloy (for example, aluminum, nickel, copper, and silver), metal oxide (for example, yttrium oxide, tin oxide, indium, oxide, antimony oxide, and $SnO_2$—$In_2O_3$ composite oxide), and ion conductive material (for example, potassium titanate and LiCl).

The conductive material is selected according to a purpose of use thereof. As an example of the conductive material, carbon black may be used, and particularly, from the viewpoints of the stability over time of the electric resistance and the electric field dependence that prevents electric field concentration due to the transfer voltage, oxidized carbon black (for example, carbon black obtained by applying a carboxyl group, a quinone group, a lactone group, a hydroxyl group or the like to the surface) having a pH of 5 or less (preferably a pH of 4.5 or less, and further preferably a pH of 4.0 or less).

The content of the conductive material in the belt member is selected by the target resistance. For example, it is preferably from 1% by weight to 50% by weight, is further preferably from 2% by weight to 40% by weight, and is still further preferably from 4% by weight to 30% by weight with respect to the entire weight of the belt member.

The conductive material may be used alone and two or more types thereof may be used in combination.

Examples of additives other than the conductive material include a dispersant for improving the dispersibility of the conductive material (such as carbon black), various fillers for imparting various functions such as mechanical strength, a catalyst, a leveling agent for improving the quality of film formation, and a releasable material for improving releasability (fluororesin particles such as polytetrafluoroethylene (PTFE), tetrafluoroethylene-perfluoroalkylvinylether copolymer (PFA), and tetrafluoroethylene-hexafluoropropylene copolymer (FEP)).

Properties of Belt Member

From the viewpoint of the transfer properties, the surface resistivity of an outer peripheral surface of the belt member used as the transfer unit is preferably from 9 (Log Ω/square) to 13 (Log Ω/square), and is further preferably 10 (Log Ω/square) to 12 (Log Ω/square) at a common logarithmic value.

Note that, the common logarithmic value of the surface resistivity is controlled by the kinds of the conductive materials and the additive amount of the conductive material.

Figure 7A:
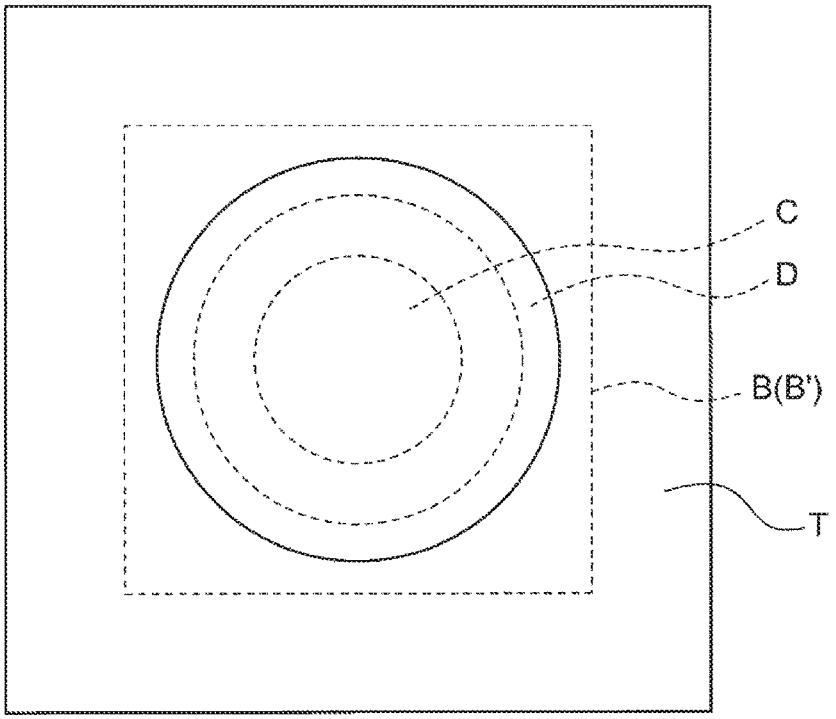
FIG. 7A is a schematic plan view illustrating an example of a circular electrode.
Figure 7B:
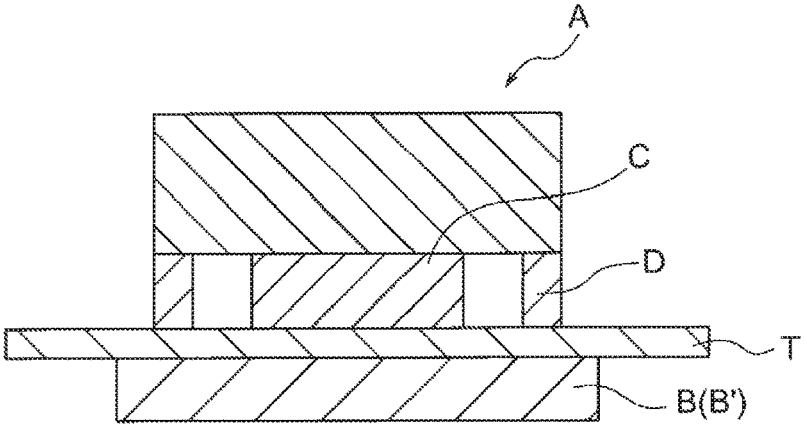
FIG. 7B is a schematic sectional view thereof.

Here, the method of measuring the surface resistivity is performed as follows. The measurement is performed With a circular electrode (for example, UR probe of HIGH-LESTER IP manufactured by Mitsubishi Chemical Corporation) based on JIS-K6911 (1995). The method of measuring the surface resistivity will be described with reference to the drawings. FIG. 7A is a plan view schematically illustrating an example of a circular electrode, and FIG. 7B is a schematic sectional view thereof. The circular electrode as illustrated in FIG. 7 is provided with a first voltage applying electrode A and a plate insulator B. The first voltage applying electrode A is provided with a cylindrical electrode portion C and a ring-shaped electrode portion D which has an inner diameter larger than the outer diameter of the cylindrical electrode portion C, and surrounds the cylindrical electrode portion C at a regular interval. A current I (A) which flows when a belt T is nipped between the cylindrical electrode portion C, the ring-shaped electrode portion D, and the plate insulator B in the first voltage applying electrode A, and then a voltage V (V) is applied between the cylindrical electrode portion C and the ring-shaped electrode portion D in the first voltage applying electrode A is measured, and the surface resistivity ρs (Ω/square) of the transfer surface of the belt T is calculated by using the following Expression. Here, in the following Expression, d (mm) represents an outer diameter of the cylindrical electrode portion C, and D (mm) represents an inner diameter of the ring-shaped electrode portion D.

$$\rho s=\pi\times(D+d)/(D-d)\times(V/I) \qquad \text{Expression:}$$

Note that, the surface resistivity is calculated by obtaining the current value after applying 500 V of voltage to the circular electrode (UR probe of HIGH-LESTER IP manufactured by Mitsubishi Chemical Corporation: outer diameter of Φ16 mm of the cylindrical electrode portion C, inner diameter of Φ30 mm and outer diameter of Φ40 mm of the ring-shaped electrode portion D) for 10 seconds under the environment at 22° C./55% RH.

In a case where the belt member is used as the intermediate transfer belt, the recording medium feed belt, or the like in the image forming apparatus, the entire volume resistivity of the belt member is preferably from 8

(LogΩcm) to 13 (LogΩcm) in terms on a common logarithmic value from the viewpoint of the transfer properties. Note that, the common logarithmic value of the volume resistivity is controlled by the kinds of conductive materials and the additional amount of the conductive materials.

Here, the measurement of the volume resistivity is performed by using the circular electrode (for example, UR probe of HIGH-LESTER IP manufactured by Mitsubishi Chemical Corporation) based on JIS-K6911 (1995). The measuring method of the volume resistivity will be described with reference to FIG. 7, The measurement is performed by using the same apparatus as that used for measuring the surface resistivity. Note that, in the circular electrode as illustrated in FIG. 7, a second voltage applying electrode B' is provided instead of the plate insulator B used when the surface resistivity is measured. In addition, a current I (A) which flows when a belt T is nipped between the cylindrical electrode portion C, the ring-shaped electrode portion D, and the second voltage applying electrode B' in the first voltage applying electrode A, and a voltage V (V) is applied to the cylindrical electrode portion C and the second voltage applying electrode B in the first voltage applying electrode A is measured, and the volume resistivity ρv (Ωcm) of belt T is calculated by using the following Expression. Here, in the following Expression, t represents the thickness of the belt T.

$$\rho v = 19.6 \times (V/I) \times t \qquad \text{Expression}$$

The volume resistivity is calculated by obtaining the current value after applying 500 V of voltage to the circular electrode (UR probe of HIGH-LESTER IP manufactured by Mitsubishi Chemical Corporation: outer diameter of Φ16 mm of the cylindrical electrode portion C, inner diameter of Φ30 mm and outer diameter of Φ40 mm of the ring-shaped electrode portion D) for 10 seconds under the environment at 22° C./55% RH.

Further, the numerical value of 19.6 indicated in the above Expression means an electrode coefficient for conversion to resistance, and is calculated as $\pi d^2/4t$ by the outer diameter d (mm) of the cylindrical electrode portion and the thickness t (cm) of the sample. In addition, the thickness of the belt T is measured by using an eddy current type film thickness meter CTR-1500E manufactured by Sanko Electronics Group.

The thickness (average thickness) of the belt member is preferably from 0.05 mm to 0.5 mm, is further preferably from 0.06 mm to 0.30 mm, and is further preferably from 0.06 mm to 0.15 mm.

Electrostatic Charge Image Developing Toner

Next, in the image forming apparatus according to the exemplary embodiment, the electrostatic charge image developing toner contained in the electrostatic charge image developer accommodated in the developing unit will be described in detail.

In the exemplary embodiment, the above-described specific pulverized toner is used as the electrostatic charge image developing toner. That is, as the toner, a toner which includes toner particles (pulverized toner particles) containing a binder resin which contains an amorphous resin and a crystalline resin, and paraffin wax having a melting temperature from 60° C. to 80° C. is used, and in the toner, the absolute value of a difference between the melting temperature of the crystalline resin and the melting temperature of the paraffin wax is 10° C. or less, the volume average particle diameter of the toner particles is from 6 μm to 9 μm, a shape factor SF1 of the toner particles is 140 or more, and a toluene-insoluble portion of the toner is from 25% by weight to 45% by weight.

Hereinafter, components of the toner in the exemplary embodiment will be described.

Toner Particles

The toner particles are configured to include a binder resin, a release agent containing at least specific paraffin wax, and if necessary, a coloring agent and other additives.

Binder Resin

As the binder resin, an amorphous resin and a crystalline resin are used in combination. With respect to the binder resin, the crystalline resin is used in combination with the amorphous resin, thereby providing excellent low temperature fixability.

Here, the amorphous resin means a resin having only a stepwise endothermic change without a definite endothermic peak in a thermal analysis measurement using differential scanning calorimetry (DSC), and is a solid at room temperature and thermoplastic at a temperature equal to or higher than a glass transition temperature.

On the other hand, the crystalline resin means a resin having a definite endothermic peak without a stepwise endothermic change in the differential scanning calorimetry (DSC).

Specifically, for example, the crystalline resin means that the half-width of the endothermic peak when measured at a heating rate of 10° C./min is within 10° C., and the amorphous resin means a resin having the half-width of greater than 10° C., or a resin in which the definite endothermic peak is not recognized.

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and modified rosin, a mixture thereof with the above-described vinyl resins, or a graft polymer obtained by polymerizing a vinyl monomer in the coexistence of such non-vinyl resins.

As the binder resin, two or more of the resins including the amorphous resin and the crystalline resin may be used in combination.

As the binder resin, a polyester resin is preferably used.

In the exemplary embodiment, it is preferable that the amorphous polyester resin and the crystalline polyester resin are used in combination. Note that, the content of the crystalline polyester resin may be from 2% by weight to 40% by weight (preferably from 2% by weight to 20% by weight) with respect to the entire binder resins.

Amorphous Polyester Resin

Examples of the amorphous polyester resin include condensation polymers of a polyvalent carboxylic acid and a polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalicacid, and naphthalene dicarboxylic acid), and an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a cross linked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone and two or more types thereof may be used in combination.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), and aromatic diol ( for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaervthritol.

The polyol may be used alone and two or more types thereof may be used in combination.

The glass transition temperature (Tg) of the amorphous polyester resin is preferably in a range of 50° C. to 80° C., and further preferably in a range of 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K7121-1987 "testing methods for transition temperatures of plastics".

The weight average molecular weight (Mw) of the amorphous polyester resin is preferably from 5,000 to 1,000,000, and is further preferably from 7,000 to 500,000.

The number average molecular weight (Mn) of the amorphous polyester resin is from 2,000 to 100,000.

The molecular weight distribution Mw/Mn of the amorphous polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC·HLC-8120 GPC, manufactured by Tosoh Corporation as a measuring device, Column TSK GEL SUPER HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the amorphous polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent maybe added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include condensation polymers of a polyvalent carboxylic acid and a polyol. A commercially available product or a synthesized product may be used as the crystalline polyester resin.

Here, in order to easily form a crystal structure, the crystalline polyester resin may be a polycondensate using a polymerizable monomer having a linear aliphatic group rather than a polymerizable monomer having an aromatic group.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid), aromatic dicarboxylic acid (for example, dibasic acid such as phthalic acid, isophthalic acid, terephthalic acid, and naphthalene-2,6-dicarboxylic acid), and an anhydride thereof, or lower alkyl esters (having, for example, from 1 to 5 carbon atoms) thereof.

As the polyvalent carboxylic acid, tri- or higher-valent carboxylic acid employing a crosslinked structure or a branched structure may be used in combination together with dicarboxylic acid. Examples of the tri-valent carboxylic acid include aromatic carboxylic acid (for example, 1,2,3-benzene tricarboxylic acid, 1,2,4-benzene tricarboxylic acid, and 1,2,4-naphthalene tricarboxylic acid), and anhydrides thereof, or lower alkyl esters (having, for example, 1 to 5 carbon atoms) thereof.

As the polycarboxylic acid, a dicarboxylic acid having a sulfonic acid group and a dicarboxylic acid having an etnylenic double bond may be used together with these dicarboxylic acids.

The polyvalent carboxylic acids may be used alone and two or more types thereof may be used in combination.

Examples of the polyol include aliphatic diol (for example, a linear type aliphatic diol having the carbon number of a main chain portions is from 7 to 20). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedanediol. Among them, as the aliphatic diol, 1,8-octanediol, 1,9-nonanediol, and 1,10-decanediol are preferably used.

As the polyol, a tri- or higher-valent polyol employing a crosslinked structure or a branched structure may be used in combination together with diol. Examples of the tri- or higher-valent polyol include glycerin, trimethylolethane, trimethylolpropane, and pentaerythritol.

The polyol may be used alone and two or more types thereof may be used in combination.

Here, in the polyol, the content of the aliphatic diol may be 80% by mol or more, and is preferably 90% by mol or more.

The melting temperature of the crystalline polyester resin is preferably from 50° C. to 90° C., is further preferably from 55° C. to 90° C., and is still further preferably from 60° C. to 85° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The weight average molecular weight (Mw) of the crystalline polyester resin is preferably from 6,000 to 35,000.

Note that, the weight average molecular weight of the crystalline polyester resin is measured based on the method by gel permeation chromatography (GPC) in the amorphous polyester resin.

The crystalline polyester resin is obtained by a known preparing method similar to the case of the amorphous polyester resin.

The content of the crystalline resin (preferably a crystalline polyester resin) is preferably from 3% or 3% by weight to 20% by weight, and is preferably from 5% by weight to 15% by weight with respect to the entire amount of the toner.

When the content of the crystalline resin is within the above range, it is possible to obtain excellent low temperature fixability.

Release Agent

Specific Paraffin Wax

The toner particles at least contain paraffin wax (specific paraffin wax) having a melting temperature of from 60° C. to 80° C., as a release agent. The melting temperature of the specific paraffin wax is preferably from 65° C. to 78° C., and is further preferably from 65° C. to 75° C.

When the melting temperature of the paraffinic wax is 80° C. or less, the excellent low temperature fixability is obtained; whereas, when the melting temperature is 60° C. or more, the storage stability of the toner is enhanced.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

Examples of the paraffin wax include polyethylene type wax and polypropylene type wax.

Note that, the toner particles may contain release agents (hereinafter, may be simply referred to as "other release agents") other than specific paraffin wax.

Examples of other release agents include paraffin wax having a melting temperature of lower than 60° C. or higher than 80° C.; hydrocarbon wax other than paraffinic wax; natural waxes such as carnauba wax, rice wax, and candelilla wax; synthetic or mineral/petroleum waxes such as montan wax; and ester waxes such as fatty acid esters and montanic acid esters. However, other release agents are not limited to the above examples.

The content of the release agent is preferably from 1% by weight to 20% by weight, and is preferably from 5% by weight to 15% by weight with respect to the toner particles.

Note that, in a case where the toner particles contain other release agents, the content of the specific paraffin wax having a melting temperature from 60° C. to 80° C. is preferably greater than 50% by weight, and is further preferably 60% by weight or more with respect to the entire amount of the release agent.

Absolute Value of Difference between Melting Temperature of Crystalline Resin and Melting Temperature of Paraffin Wax The toner particles in the exemplary embodiment include the crystalline resin and the specific paraffin wax having the melting temperature from 60° C. to 80° C., and the absolute value of the difference between the melting temperature of the crystalline resin and the melting temperature of the specific paraffin wax is 10° C. or less. The absolute value of the above difference is preferably 8° C. or less, is further preferably 5° C. or less, and the smaller the absolute value of the difference is, the better.

The absolute value of the difference in the melting temperature of the crystalline resin and the specific paraffin wax is 10° C. or less, and thus it is possible to obtain excellent fixibility.

Coloring Agent

Examples of the coloring agent includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phtnalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents may be used alone and two or more types thereof may be used in combination.

As the coloring agent, if necessary, a surface-treated coloring agent may be used, or a dispersant may be used in combination. Further, plural kinds of coloring agents may be used in combination.

The content of the coloring agent is preferably from 1% by weight to 30% by weight, and is further preferably from 3% by weight to 15% by weight with respect to the total amount of the toner particles.

Other Additives

Examples of other additives include well-known additives such as a magnetic material, a charge-controlling agent, and an inorganic powder. These additives are contained in the toner particle as an internal additive.

Volume Average Particle Diameter of Toner Particles

The volume average particle diameter of the toner particles is from 6 μm to 9 μm, is preferably from 6.5 μm to 8 μm, and is further preferably from 6.5 μm to 7.5 μm.

When the volume average particle diameter of the toner particles is 6 μm or more, the preparing suitability at the time of the preparation by the pulverization method is obtained. On the other hand, when the volume average particle diameter is 9 μm or less, the toner particles have a relatively small diameter, thereby making it easy to obtain high quality images.

The volume average particle diameter of the toner particles is measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to from 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for one minute, and a particle diameter distribution of particles having a particle diameter of from 2 μm to 60 μm is measured by a COULTER MULTISIZER II with an aperture having an aperture diameter of 100 μm. 50,000 particles are sampled.

Cumulative distributions by volume are drawn from the side of the smallest diameter with respect to particle diameter ranges (channels) separated based on the measured particle diameter distribution, and then the particle diameter when the cumulative percentage becomes 50% is defined as volume average particle diameter D50v.

Shape Factor SF1 of Toner Particles

The shape factor SF1 of the toner particles is 140 or more, is preferably 141 or more, and is further preferably 143 or more. When the shape factor SF1 of the toner particles is 140 or more, the preparing suitability at the time of the preparation by the pulverization method is obtained.

On the other hand, the upper limit value of the shape factor SF1 is preferably 155 or less, is further preferably 153 or less, and is still further preferably 151 or less from the viewpoint that a shape close to a sphere is provided, thereby easily obtaining a nigh quality image.

In addition, the toner particles having the shape factor SF1 of 140 or more are generally prepared by using the pulverization method such as a kneading and pulverizing method. A method of preparing the toner particles by using the pulverization method will be described below.

The shape factor SF1 is calculated by the following Expression.

$$SF1=(ML^2/A)\times(\pi/4)\times 100 \qquad \text{Expression:}$$

In the above Expression, ML represents an absolute maximum length of the toner, and A represents a projected area of the toner.

Specifically, the shape factor SF1 is digitized by analyzing mainly a microscope image or a scanning electron microscope (SEM) image using an image analyzer, and is calculated as follows. That is, the shape factor SF1 is obtained by capturing an optical microscopic image of particles scattered on the surface of a slide glass into a LUZEX image analyzer by using a video camera, and measuring the maximum length and the projected area of 100 particles, calculation is performed according to the above Expression, and the average value is obtained.

External Additives

In the exemplary embodiment, from the viewpoint of improving the transfer properties of the toner image, the external additives may be added to the surface of the toner particles.

Examples of the external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO. $SiO_2$, $K_2O.(TiO_2)n$, $Al_2O_3.2SiO_2$, $CaCO_3$, $MgCO_2$, $BaSO_4$, and $MgSO_4$.

Among them, from the viewpoint of the transfer properties (spacer effect) of the toner image, $SiO_2$ particles (silica particles) are preferable.

The silica particles may be silica, that is, particles containing $SiO_2$ as a main component, and may be crystalline or amorphous. The silica particles may be particles produced from a silicon compound such as water glass, alkoxysilane or the like as a raw material, or particles obtained by pulverizing quartz.

Specifically, examples of the silica particles include sol-gel silica particles, aqueous colloidal silica particles, alcoholic silica particles, fumed silica particles obtained by using a vapor phase method, melted silica particles and the like.

The silica particles are preferably monodisperse and spherical. The monodisperse spherical silica particles are dispersed on the surface of the toner particles in a nearly uniform state, and a spacer effect is obtained.

Here, as a definition of monodisperse, it may be discussed by standard deviation with respect to the average particle diameter including aggregates, and the standard deviation is preferably equal to or less than the volume average particle diameter D50×0.22. In addition, as a definition of a spherical shape, it may be discussed with an average circularity to be described below.

Surfaces of the inorganic particles as an external additive may be treated with a hydrophobizing agent. The hydroprtobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The average particle diameter (the primary particle diameter) of the external additives is preferably from 10 nm to 1,000 nm, is further preferably from 30 nm to 500 nm, and is still further preferably from 50 nm to 300 nm.

Here, the average particle diameter of the external additives is measured by the following method.

The primary particles of the external additives are observed with a scanning electron microscope (SEM) apparatus (manufactured by Hitachi, Ltd.:S-4100) to capture an image, and the image is put in an image analyzer (LUZEXIII, manufactured by NIRECO CORPORATION), an area of each particle is measured by image analysis of the primary particles, and thereby an equivalent circle diameter is calculated from this area value. The calculation of the equivalent circle diameter is performed, on 100 external additives. In addition, the 50% of diameter (D50) at the cumulative frequency on volume basis of the obtained equivalent circle diameter is set as an average primary particle diameter (average equivalent circle diameter D50) of the external additives. Note that, in the electron microscope, the magnification is adjusted so that the external additives appear in the range from 10 to 50 in one field of view, and the equivalent circle diameter of the primary particle is obtained bv observing the multiple fields of view.

The external addition amount of the external additives is, for example, preferably from 0.01% by weight to 5% by weight, and is further preferably from 0.01% by weight to 2.0% by weight with respect to the toner particles.

Toluene-insoluble Portion of Toner

In the toner in the exemplary embodiment, the content of the toluene-in soluble portion is from 25% by weight to 45% by weight. The toluene-insoluble portion is preferably from 28% by weight to 38% by weight, and is further preferably from 30% by weight to 35% by weight.

When the toluene-insoluble portion is 25% by weight or more, the excellent low temperature fixability is likely to be obtained and glossiness (gross) in an image is likely to be prevented from being increased as compared with the case where the toluene-insoluble portion is lower than the above range.

On the other hand, when the toluene-insoluble portion is 45% by weight or less, it is likely to obtain the excellent low temperature fixability as compared with the case where the toluene-insoluble portion is greater than the above range.

Here, the toluene-insoluble portion is toluene-insoluble components among components constituting the toner. In other words, the toluene-insoluble portion is an insoluble portion which contains a toluene-insoluble components contained in the binder resin (particularly, the high molecular weight component of the binder resin) as the main component (for example, 50% by weight or more with respect to the entire components). This toluene-insoluble port ion may be said as an index of the content of crosslinked resin contained in the toner.

The toluene-insoluble portion is a value measured by the following method.

1 g of weighed toner is put into a weighed cylindrical filter paper made of glass fiber and placed in an extraction tube of a heating type Soxhlet extraction apparatus. Then, toluene is put into the flask, and is heated to 110° C. using a mantle heater. Also, the circumference of an extraction pipe is heated to 125° C. using a heater mounted on the extraction pipe. Extraction is performed with such a reflux rate that an extraction cycle is once in the range from 4 minutes to 5 minutes. After extracting for 10 hours, the cylindrical filter paper and the toner residue are taken out, dried, and weighed.

In addition, based on Expression: toner residue amount (% by weight)=[(cylindrical filter paper amount+toner residue amount) (g)−cylindrical filter paper amount (g)]/toner amount (g)×100, the toner residue amount (% by weight) is calculated, and the calculated toner residue amount (% by weight) is designated as the toluene-insoluble portion (% by weight).

Note that, the toner residue is formed of coloring agent, inorganic substances such as external additives, a high molecular weight component of the binder resin and the like. In addition, in a case where the release agent is contained in the toner particles, the extraction is performed by heating, and thus the release agent is set as the toluene soluble content.

The toluene-insoluble portion is adjusted, in the binder resin, by 1) a method of forming a crosslinked structure or a branched structure by adding a crosslinking agent to a polymer component having a reactive functional group at the terminal, 2) a method of forming a crosslinked structure or a branched structure by a polyvalent metal ion in a polymer component having an ionic functional group at the terminal, and 3) a method of forming the extension and branch of the resin change length by performing a treatment with an isocyanate or the like.

Preparing Method of Toner

Next, a method of preparing the toner in the exemplary embodiment will be described.

The toner in the exemplary embodiment is obtained by adding an external additive to the toner particles after preparing the toner particles.

As described above, the toner particles in the exemplary embodiment are irregular toner particles (that is, the shape factor SF1 is 140 or more). The toner particles are generally prepared according to the pulverization method such as a kneading and pulverizing method.

The kneading and pulverizing method is a method of preparing the toner particles by melting and kneading the binder resin and the release agent containing the specific paraffin wax having a melting temperature within the above-described range, and then pulverizing and classifying the resultant. In the kneading and pulverizing method, for example, the toner particles are prepared through a kneading step of melting and kneading components containing the binder resin and the release agent, a cooling step of cooling the molten-kneading material, a pulverizing step of pulverizing the kneaded material after cooling, and a classification step of classifying the pulverized material.

Hereinafter, each step of the kneading and pulverizing method will be described in detail.

Kneading Step

The kneading step is a step of obtaining a kneaded material by melting and kneading a component containing a binder resin and a release agent (resin particle forming material).

Examples of a kneading machine used in the kneading step include a three-roll extruder, a single-screw extruder, a twin-screw extruder, and a banbury mixer extruder.

In addition, the melting temperature may be determined in accordance with the kinds and a blend ratio of the binder resin and the release agent to be kneaded.

Cooling Step

A cooling step is a step of cooling the kneaded material formed in the above-described kneading step.

In the cooling step, the temperature of the kneaded material at the time of completing the kneading step may be cooled down to be 40° C. or less at an average temperature lowering speed of 4° C./sec or more in order to keep the dispersed state immediately after the kneading step.

Note that, the average temperature lowering speed means an average value of the speed at which the temperature of the kneaded material at the time of completing the kneading step is cooled down to 40° C.

Examples of the cooling method in the cooling step include a method of using a rolling roller which circulates cold water or brine, and a pinched type cooling belt. Note that, in a case where the cooling is performed according to the above-described method, the cooling speed is determined by a speed of the rolling roller, a flow rate of the brine, a supply amount of the kneaded material, a slab thickness during the rolling of the kneaded material or the like. The slab thickness is preferably from 1 mm to 3 mm.

Pulverizing Step

The kneaded material which is cooled in the cooling step is pulverized in the pulverizing step so as to form a particle.

In the pulverizing step, for example, a mechanical pulverizer, a jet type pulverizer, or the like is used.

Classification Step

The pulverized materials (particles) obtained in the pulverizing step may be classified in the classification step so as to obtain toner particles of the volume average particle diameter from 6 μm to 9 μm, if necessary.

In the classification step, fine powder (particles smaller than the target diameter range) and coarse powder (particles larger than the target range) are removed by using a centrifugal classifier, an inertial classifier, or the like which is used generally.

Through the above steps, it is possible to obtain the toner particles of which the shape factor SF1 is 140 or more, and the volume average particle diameter is from 6 μm to 9 μm.

The toner in the exemplary embodiment is prepared by adding and mixing, for example, an external additive to the obtained dry toner particles. The mixing may be performed by, for example, a V-blender, a HENSCHEL MIXER, a LODIGE MIXER, or the like. Furthermore, if necessary, coarse particles of the toner may be removed by using a vibration sieving machine, a wind classifier, or the like.

Electrostatic Charge Image Developer

The electrostatic charge image developer in the exemplary embodiment includes at least the above-described toner.

The electrostatic charge image developer in the exemplary embodiment may be a one-component developer only including the above-described toner, or may be a two-component developer obtained by mixing the toner and carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particle is dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin containing an organosiloxane bond or a modified product thereof, a fluorine resin, a polyester, a polycarbonate, a phenol resin, and an epoxy resin.

Note that, other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably from toner: carrier=1:100 to 30:100, and is further preferably from 3:100 to 20:100.

EXAMPLES

Hereinafter, the exemplary embodiments will be described in detail using Examples and Comparative examples, but is not limited to the following examples.

Developer

Preparation of Crystalline Resin (A)

Dimethyl sebacate: 100 parts by weight
Hexane diol: 67.8 parts by weight
Dibutyl tin oxide: 0.10 parts by weight The respective components of the above composition are put into a three-necked flask, the mixture is reacted at 185° C. for five hours under nitrogen atmosphere while removing water generated during the reaction to the outside, and after raising the temperature up to 220° C. while slowly depressurizing, the mixture is reacted for six hours, and then the resultant is cooled. Thus, a crystalline resin (A) having a weight average molecular weight of 33,700 is prepared.

Note that, the melting temperature of the crystalline resin (A) is obtained from a DSC curve obtained by differential scanning calorimetry (DSC) based on "melting peak temperature" described in the method of obtaining a melting temperature in JIS K 7121-1987 "testing methods for transition temperatures of plastics", and the measured temperature is 71° C.

Preparation of Amorphous Resin (1)

Dimethyl terephthalate: 61 parts by weight
Dimethyl fumarate: 75 parts by weight
Dodecenylsuccinic anhydride: 34 parts by weight
Trimellitic acid: 16 parts by weight
Bisphenol A ethylene oxide adduct: 137 parts by weight
Bisphenol A propylene oxide adduct: 191 parts by weight
Dibutyl tin oxide: 0.3 parts by weight.

The respective components of the above composition are put into a three-necked flask, the mixture is reacted at 180° C. for three hours under nitrogen atmosphere while removing water generated during the reaction to the outside, and after raising the temperature up to 240° C. while slowly depressurizing, the mixture is reacted for two hours, and then the resultant is cooled. Thus, an amorphous resin (1) having a weight average molecular weight of 17,100 is prepared.

Preparation of Amorphous Resin (2)

Dimethyl terephthalate: 60 parts by weight
Dimethyl fumarate: 74 parts by weight
Dodecenylsuccinic anhydride: 30 parts by weight
Trimellitic acid: 22 parts by weight An amorphous resin (2) is prepared in the same manner as in the preparation of the amorphous resin (1) except that the component compositions are changed to the above compositions. The weight average molecular weight of the amorphous resin (2) is 17,500.

Preparation of Amorphous Resin (3)

Dimethyl terephthalate: 60 parts by weight
Dimethyl fumarate: 70 parts by weight
Dodecenylsuccinic anhydride: 29 parts by weight
Trimellitic acid: 29 parts by weight An amorphous resin (3) is prepared in the same manner as in the preparation of the amorphous resin (1) except that the component compositions are changed to the above compositions. The weight average molecular weight of the amorphous resin (3) is 16,600.

Preparation of Amorphous Resin (4)

Dimethyl terephthalate: 55 parts by weight

Dimethyl fumarate: 64 parts by weight

Dodecenylsuccinic anhydride: 27 parts by weight

Trimellitic acid: 46 parts by weight

An amorphous resin (4) is prepared in the same manner as in the preparation of the amorphous resin (1) except that the component compositions are changed to the above compositions. The weight average molecular weight of the amorphous resin (4) is 15,100.

Preparation of Toner Particles (1)

79 parts by weight of amorphous resin (1), 7 parts by weight of coloring agent (C.I. Pigment Blue 15:1), 5 parts by weight of release agent (paraffin wax, melting temperature 73° C., prepared by Nippon Seiro Co., Ltd.), and 8 parts by weight of the crystalline resin (A) (melting temperature 71° C.) are put into a HENSCHEL MIXER (manufactured by NIPPON COKE & ENGINEERING Co., Ltd.), and are mixed and stirred at a peripheral speed of 15 m/sec for five minutes, and then the obtained stirred mixture is molten-kneaded by an extruder type continuous kneader.

Here, the setting condition of the extruder is that a supply side temperature is 160° C., a discharge side temperature is 130° C., and the supply side temperature and the discharge side temperature of the cooling roller are 40° C. and 25° C., respectively. Note that, the temperature of the cooling belt is set to be 10° C.

After being cooled, the obtained molten-kneading material is roughly pulverized by using a hammer mill, is finely pulverized such that a diameter thereof becomes 6.5 μm by a jet millpulverizer (manufactured by Nippon Pneumatic Mfg. Co., Ltd.), and then is classified by an elbow jet classifier (Nittetsu Mining Co., Ltd. Model: EJ-LABO), thereby obtaining toner particles (1).

As a result of measuring the volume average particle diameter and SF1 of the toner particles (1) by using the above-described method, the volume average particle diameter is 6.9 μm, and the shape factor SF1 is 145.

Preparation of Toner (1)

100 parts by weight of the toner particles (1) and 1.2 parts by weight of commercially available fumed silica RX50 (prepared by Nippon Aerosil Co., Ltd.) as the external additives are mixed at a peripheral speed of 30 m/s, for five minutes by a HENSCHEL MIXER (manufactured by Mitsui Miike Machinery Co., Ltd.). As a result, a toner (1) is obtained.

Preparation of Toner (2)

Toner particles (2) are obtained in the same manner as in the case of the toner particles (1) except that an amorphous resin (2) is used instead of the amorphous resin (1).

The volume average particle diameter of the toner particles (2) is 6.8 μm, and the shape factor SF1 is 147.

Then, a toner (2) is obtained in the same manner as in the case of the toner (1) except that the toner particles (2) are used.

Preparation of Toner (3)

Toner particles (3) are obtained in the same manner as in the case of the toner particles (1) except that an amorphous resin (3) is used instead of the amorphous resin (1).

The volume average particle diameter of the toner particles (3) is 7.0 μm, and the shape factor SF1 is 149.

Then, a toner (3) is obtained in the same manner as in the case of the toner (1) except that the toner particles (3) are used.

Preparation of Toner (4)

Toner particles (4) are obtained in the same manner as in the case of the toner particles (1) except that an amorphous resin (4) is used instead of the amorphous resin (1).

The volume average particle diameter of the toner particles (4) is 7.3 μm, and the shape factor SF1 is 151.

Then, a toner (4) is obtained in the same manner as in the case of the toner (1) except that the toner particles (4) are used.

Preparation of Toner (1C) for Comparative Example

Toner particles (1C) are obtained in the same manner as in the case of the toner particles (1) except that paraffin wax (HNP9, melting temperature 77° C., prepared by Nippon Seiro Co., Ltd.) is used instead of paraffin wax used in the toner particles (1).

The volume average particle diameter of the toner particles (1C) is 7.0 μm, and the shape factor SF1 is 146.

Then, a toner (1C) is obtained in the same manner as in the case of the toner (1) except that the toner particles (1C) are used.

Measuring of Toluene-insoluble Portion

The toluene-insoluble portion of the toner obtained in each Example is measured by using the above-described method. The results are shown in Table 1.

Preparation of Developer

A two-component developer is prepared by mixing 8 parts by weight of toner obtained in each example and 100 parts by weight of carrier.

The carrier is obtained in such a manner that 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components except for ferrite particles are dispersed by being stirred for 10 minutes with a stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, so that the mixture is dried, and then classifying with a mesh of 105 μm is performed.

Image Forming Apparatus

Preparation of Image Forming Apparatus (1)

As an image forming apparatus, COLOR1000PRESS manufactured by Fujixerox Co., Ltd is prepared. Note that, the image forming apparatus is an intermediate transfer type apparatus which is provided with an intermediate transfer belt. As the transfer member, as illustrated in FIG. 2, that is, the primary transfer roller is provided at a position (offset position) deviating from the reference position (the contact position between the intermediate transfer belt and the photoreceptor in a state of not being deformed by the primary transfer member) to the deviating position (offset position) toward the downstream side of the intermediate transfer belt in the driving direction.

In addition, as the intermediate transfer belt, a belt member which is made of a polyimide resin and made semiconductive by adding carbon black is provided.

A developer including the toners (1) to (4), or the toner (1C) indicated in the following Table 1 is accommodated in a developing device of the image forming apparatus.

A nip width in the primary transfer position of the image forming apparatus (1) is 7 mm.

Preparation of Image Forming Apparatus (2)

In the image forming apparatus (1), the number and positions of the dispositions of the primary transfer rollers (transfer members) are changed. Specifically, as the transfer member, the components are changed as described in the exemplary embodiment illustrated in FIG. 3, that is, the primary transfer roller disposed at a position (offset position) deviating from the reference position (the contact position between the intermediate transfer belt and the photoreceptor in a state of not being deformed bv the primary transfer member), and the primary transfer roller disposed at a position (offset position) deviating from the reference position to the deviating position (offset position) toward the downstream side of the intermediate transfer belt in the driving direction are provided. Note that, the transfer bias is only applied to the primary transfer roller disposed on the upstream side of the intermediate transfer belt in the driving direction (that is, the primary transfer roller disposed at a reference position).

Except for the above matters, an image forming apparatus (2) having the same configuration as that of the image forming apparatus (1) is prepared.

The nip width in the primary transfer position of the image forming apparatus (2) is 22 mm.

Preparation of Image forming apparatus (C1) for Comparative Example

An image forming apparatus (C1) having the same configuration as that of the image forming apparatus (1) is prepared except that the position where the primary transfer roller (the transfer member) is disposed is changed to the reference position (contact position between the intermediate transfer belt and the photoreceptor in a state of not being deformed by the transfer member).

A nip width in the primary transfer position of the image forming apparatus (C1) is 3 mm.

Evaluation

Evaluation of Transfer Properties

The transfer properties are evaluated using the image forming apparatus according to the following method.

A 100% solid patch is formed on the image holding member (photoreceptor), the primary transfer is performed on the intermediate transfer belt, and the patch on the photoreceptor and the weight of the patch on the intermediate transfer belt are measured. The value obtained by "weight of toner on intermediate transfer belt/weight of toner on photoreceptor ×100" is designated as transfer efficiency (%), and the transfer properties are evaluated based on the transfer efficiency. Note that, there is no practical problem as long as the transfer efficiency is 98% or more.

Evaluation of Low Temperature Fixability

The low temperature fixability evaluated using the image forming apparatus according to the following method.

The fixing device of the image forming apparatus (COLOR1000PRESS) is removed, and a fixing device remodeled so as to change the fixing temperature is used. Unfixed images before rushing into the fixing device in this image forming apparatus are collected, these unfixed images are fixed at an interval of 5° C. from a fixing temperature of 100° C., the presence and absence of cold offset (phenomenon that toner is transferred to the fixing member, which is caused when the toner image is not sufficiently heated) is visually confirmed, and then the temperature at which the cold offset disappears is evaluated as a lowest fixing temperature. Note that, there is no practical problem as long as the lowest fixing temperature is 140° C. or less.

TABLE 1

| | | Toner | | | | | | | Image forming apparatus | | |
|---|---|---|---|---|---|---|---|---|---|---|---|
| | | Types | Melting temperature of crystalline resin (A) [° C.] | Melting temperature of paraffin wax (B) [° C.] | Difference of melting temperature \|A − B\| [° C.] | Volume average particle diameter of toner particles [μm] | Shape factor SF1 of toner particles | Toluene-insoluble portion [% by weight] | Types | Disposition of primary transfer roller | Nip width [mm] |
| Examples | 1 | (1) | 71 | 73 | 2 | 6.9 | 145 | 25 | (1) | Offset | 7 |
| | 2 | (2) | 71 | 73 | 2 | 6.8 | 147 | 31 | (1) | Offset | 7 |
| | 3 | (3) | 71 | 73 | 2 | 7.0 | 149 | 38 | (1) | Offset | 7 |
| | 4 | (4) | 71 | 73 | 2 | 7.3 | 151 | 45 | (1) | Offset | 7 |
| | 5 | (1) | 71 | 73 | 2 | 6.9 | 145 | 25 | (2) | Offset + reference position | 22 |
| | 6 | (2) | 71 | 73 | 2 | 6.8 | 147 | 31 | (2) | Offset + reference position | 22 |
| | 7 | (3) | 71 | 73 | 2 | 7.0 | 149 | 38 | (2) | Offset + reference position | 22 |
| | 8 | (4) | 71 | 73 | 2 | 7.3 | 151 | 45 | (2) | Offset + reference position | 22 |
| Comparative Examples | 1 | (C1) | 71 | 77 | 6 | 7.0 | 146 | 20 | (1) | Offset | 7 |
| | 2 | (C1) | 71 | 77 | 6 | 7.0 | 146 | 20 | (2) | Offset + reference position | 22 |
| | 3 | (1) | 71 | 73 | 2 | 6.9 | 145 | 25 | (C1) | Only reference position | 3 |
| | 4 | (2) | 71 | 73 | 2 | 6.8 | 147 | 31 | (C1) | Only reference position | 3 |
| | 5 | (3) | 71 | 73 | 2 | 7.0 | 149 | 38 | (C1) | Only reference position | 3 |

TABLE 1-continued

| | Toner | | | | | | | Image forming apparatus | | |
|---|---|---|---|---|---|---|---|---|---|---|
| | Types | Melting temperature of crystalline resin (A) [° C.] | Melting temperature of paraffin wax (B) [° C.] | Difference of melting temperature \|A − B\| [° C.] | Volume average particle diameter of toner particles [μm] | Shape factor SF1 of toner particles | Toluene-insoluble portion [% by weight] | Types | Disposition of primary transfer roller | Nip width [mm] |
| 6 | (4) | 71 | 73 | 2 | 7.3 | 151 | 45 | (C1) | Only reference position | 3 |

TABLE 2

| | | Evaluation | |
|---|---|---|---|
| | | Transfer efficiency | Low temperature fixability |
| Examples | 1 | 98.5 | 135 |
| | 2 | 98.3 | 130 |
| | 3 | 98.7 | 130 |
| | 4 | 98.4 | 135 |
| | 5 | 99.2 | 130 |
| | 6 | 99.0 | 135 |
| | 7 | 99.1 | 135 |
| | 8 | 99.3 | 140 |
| Comparative Examples | 1 | 98.6 | 150 |
| | 2 | 98.4 | 145 |
| | 3 | 97.2 | 135 |
| | 4 | 96.8 | 135 |
| | 5 | 97.3 | 130 |
| | 6 | 97.5 | 135 |

From the above results, In Examples in which at least one of the transfer members is disposed at a position (offset position) deviated from the reference position (the contact position between the intermediate transfer belt and the photoreceptor in a state of not being deformed by the transfer member), the transfer properties of the toner image are excellent as compared with Comparative Examples 3 to 6 in which the transfer member is disposed only at the reference position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit configured to charge a surface of the image holding member;

an electrostatic charge image forming unit configured to form an electrostatic charge image on the charged surface of the image holding member;

a developing unit that includes an electrostatic charge image developer containing an electrostatic charge image developing toner, the developing unit being configured to develop the electrostatic charge image on the surface of the image holding member to form a toner image;

a transfer unit configured to transfer the toner image onto a recording medium; and a fixing unit configured to fix the toner image on the recording medium, wherein the transfer unit includes a belt member having an outer peripheral surface which contacts the image holding member, and a transfer member, and the belt member contacts both of the image holding member and the transfer member;

wherein a contact nip formed between the image holding member and the belt member includes an upstream edge and a downstream edge, and wherein the transfer member is configured to press against the belt member at one of the upstream edge and the downstream edge of the contact nip; and wherein the electrostatic charge image developing toner includes:

a binder resin containing an amorphous resin and a crystalline resin, and paraffin wax, wherein the toner has a volume average particle diameter of 6 μm to 9 μm, a shape factor SF1 of 140 or more, and a toluene-insoluble portion of greater than 30% by weight and not greater than 35% by weight, the paraffin wax has a melting temperature of 60° C. to 80° C., and an absolute value of a difference between a melting temperature of the crystalline resin and a melting temperature of the paraffin wax is 10° C. or less.

2. The image forming apparatus according to claim 1, wherein the melting temperature of the paraffin wax is from 65° C. to 78° C.

3. The image forming apparatus according to claim 1, wherein the melting temperature of the paraffin wax is from 65° C. to 75° C.

4. The image forming apparatus according to claim 1, wherein the absolute value of the difference between the melting temperature of the crystalline resin and the melting temperature of the paraffin wax is 5° C. or less.

5. The image forming apparatus according to claim 1, wherein the crystalline resin is a polyester resin.

6. The image forming apparatus according to claim 1, wherein a content of the crystalline resin is from 3% by weight to 20% by weight with respect to the toner.

7. The image forming apparatus according to claim 1, wherein a content of the crystalline resin is from 5% by weight to 15% by weight with respect to the toner.

8. The image forming apparatus according to claim 1, wherein in the transfer unit, a plurality of the transfer members are disposed at a position facing one image holding member via the belt member.

9. The image forming apparatus according to claim 8, further comprising:

a pressure applying belt that is provided over the plurality of the transfer members, the pressure applying belt being configured to apply pressure to the belt member in a direction of the image holding member.

10. The image forming apparatus according to claim 1, wherein the transfer member is configured to press against the belt member at one of the upstream edge and the downstream edge of the contact nip without pressing against the belt member at the other of the upstream edge and the downstream edge of the contact nip.

11. The image forming apparatus according to claim 10, wherein the transfer unit includes a second transfer member configured to press against the belt member at the other of the upstream edge and the downstream edge of the contact nip.

12. The image forming apparatus according to claim 1, wherein a width of the contact nip from the upstream edge to the downstream edge is 5 mm or more and 60 mm or less.

13. The image forming apparatus according to claim 1, wherein a width of the contact nip from the upstream edge to the downstream edge is 20 mm or more and 40 mm or less.

14. The image forming apparatus according to claim 1, wherein the transfer member is configured to press against the belt member at a position other than a non-deformed contact position between the image holding member and the belt member, the non-deformed contact position being a contact position between the image holding member and the belt member in a state in which the transfer member does not press against the belt member.

15. The image forming apparatus according to claim 14, wherein the position at which the transfer member is configured to press against the belt member is provided downstream from the non-deformed contact position in a belt traveling direction.

16. The image forming apparatus according to claim 15, wherein the transfer unit includes a second transfer member configured to press against the belt member at a second position upstream from the non-deformed contact position in the belt traveling direction.

17. The image forming apparatus according to claim 14, wherein the transfer unit includes a second transfer member configured to press against the belt member at the non-deformed contact position.

* * * * *